US011248501B2

(12) United States Patent
Cecur

(10) Patent No.: US 11,248,501 B2
(45) Date of Patent: Feb. 15, 2022

(54) ROCKER ARM

(71) Applicant: Eaton Intelligent Power Limited, Dublin (IE)

(72) Inventor: Majo Cecur, Rivarolo Canavese (IT)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/629,040

(22) PCT Filed: Jul. 7, 2018

(86) PCT No.: PCT/EP2018/068456
§ 371 (c)(1),
(2) Date: Jan. 7, 2020

(87) PCT Pub. No.: WO2019/008182
PCT Pub. Date: Jan. 10, 2019

(65) Prior Publication Data

US 2020/0131948 A1 Apr. 30, 2020

(30) Foreign Application Priority Data

Jul. 7, 2017 (GB) ..... 1710961

(51) Int. Cl.
*F01L 1/18* (2006.01)
*F01L 1/26* (2006.01)
(Continued)

(52) U.S. Cl.
CPC ..... *F01L 1/185* (2013.01); *F01L 1/267* (2013.01); *F01L 13/0005* (2013.01);
(Continued)

(58) Field of Classification Search
CPC ... F01L 1/185; F01L 1/267; F01L 1/18; F01L 13/0005; F01L 13/00; F01L 2013/001;
(Continued)

(56) References Cited

U.S. PATENT DOCUMENTS 5,653,198 A * 8/1997 Diggs ..... F01L 1/185 123/198 F
6,314,928 B1 * 11/2001 Baraszu ..... F01L 13/0005 123/90.16
(Continued)

FOREIGN PATENT DOCUMENTS

CN 102373979 B 8/2015
CN 104271902 B 11/2016
(Continued)

*Primary Examiner* — Devon C Kramer
*Assistant Examiner* — Kelsey L Stanek
(74) *Attorney, Agent, or Firm* — Mei & Mark, LLP

(57) ABSTRACT

A dual body rocker arm for controlling a valve of a cylinder of an internal combustion engine includes: a first body; a second body; and a latching arrangement moveable to latch and unlatch the first body and the second body. The latching arrangement includes: a latch pin moveable between a first position in which the latch pin latches the first body and the second body together and a second position in which the first body and the second body are un-latched; and a lever mounted for pivotal motion relative to the first body, a first end of the lever contacting the latch pin, and a second end of the lever configured to contact an actuation arrangement. In use, when the actuation arrangement exerts a force on the second end of the lever, the lever pivots such that the first end of the lever exerts a force on the latch pin.

20 Claims, 23 Drawing Sheets

(51) Int. Cl.
*F01L 13/00* (2006.01)
*F01L 31/08* (2006.01)

(52) U.S. Cl.
CPC ..... *F01L 31/08* (2013.01); *F01L 2001/186* (2013.01); *F01L 2013/001* (2013.01); *F01L 2013/103* (2013.01); *F01L 2305/00* (2020.05)

(58) Field of Classification Search
CPC ..... F01L 2013/103; F01L 2001/186; F01L 31/08; F01L 2305/00
USPC ..... 123/90.39
See application file for complete search history.

(56) References Cited

U.S. PATENT DOCUMENTS

| | | | | |
|---|---|---|---|---|
| 6,499,451 | B1 * | 12/2002 | Hendriksma | F01L 1/08 123/90.16 |
| 7,677,213 | B2 | 3/2010 | Deierlein | |
| 8,215,275 | B2 | 7/2012 | Church | |
| 8,635,980 | B2 | 1/2014 | Church | |
| 8,939,118 | B2 | 1/2015 | Stoody | |
| 9,140,148 | B2 | 9/2015 | Church | |
| 9,157,381 | B2 | 10/2015 | Nowak et al. | |
| 10,196,944 | B2 | 2/2019 | Evans et al. | |
| 10,550,739 | B2 | 2/2020 | Raimondi | |
| 10,968,787 | B2 | 4/2021 | Church | |
| 2004/0035381 | A1 * | 2/2004 | Burch | F01L 1/185 123/90.16 |
| 2012/0037107 | A1 * | 2/2012 | Church | F01L 13/0005 123/90.41 |
| 2014/0209048 | A1 | 7/2014 | Manther et al. | |
| 2015/0128890 | A1 * | 5/2015 | Cecur | F01L 1/18 123/90.16 |
| 2017/0002698 | A1 | 1/2017 | Cecur | |

FOREIGN PATENT DOCUMENTS

| | | | | |
|---|---|---|---|---|
| CN | 106414918 | A | 2/2017 | |
| CN | 104321503 | B | 3/2017 | |
| CN | 106499461 | A | 3/2017 | |
| GB | 2526554 | A * | 12/2015 | F01L 1/185 |
| WO | WO 8000094 | A1 | 1/1980 | |

* cited by examiner

ROCKER ARM

CROSS-REFERENCE TO PRIOR APPLICATIONS

This application is a U.S. National Phase application under 35 U.S.C. § 371 of International Application No. PCT/EP2018/068456, filed on Jul. 7, 2018, and claims benefit to British Patent Application No. GB 1710961.2, filed on Jul. 7, 2017. The International Application was published in English on Jan. 10, 2019 as WO/2019/008182 under PCT Article 21(2).

FIELD

The present invention relates to valve train assemblies of internal combustion engines, specifically to switchable rocker arms of a valve train assembly.

BACKGROUND

Internal combustion engines may comprise switchable engine or valve train components. For example, valve train assemblies may comprise a switchable rocker arm to provide for control of a valve (for example control of an intake or exhaust valve opening) by alternating between at least two or more modes of operation (e.g. valve-lift modes). Such rocker arms typically involve multiple bodies, such as an inner arm and an outer arm. These bodies are latched together to provide one mode of operation (e.g. a first valve-lift mode) and are unlatched, and hence can pivot with respect to each other, to provide a second mode of operation (e.g. a second valve-lift mode). For example, in a first valve-lift mode the rocker arm may provide for valve opening, whereas in the second valve-lift mode the rocker arm may deactivate valve opening. This can be useful, for example, in applications such as cylinder deactivation. Typically, a moveable latch pin is used and actuated and de-actuated to switch between the two modes of operation.

SUMMARY

In an embodiment, the present invention provides a dual body rocker arm for controlling a valve of a cylinder of an internal combustion engine, the rocker arm comprising: a first body; a second body; and a latching arrangement moveable to latch and unlatch the first body and the second body, the latching arrangement comprising: a latch pin moveable between a first position in which the latch pin latches the first body and the second body together and a second position in which the first body and the second body are un-latched; and a lever mounted for pivotal motion relative to the first body, a first end of the lever contacting the latch pin, and a second end of the lever configured to contact an actuation arrangement; wherein, in use, when the actuation arrangement exerts a force on the second end of the lever, the lever is configured to pivot such that the first end of the lever exerts a force on the latch pin, thereby to move the latch pin from the first position to the second position.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Throughout the Figures, like reference signs denote like features.

Referring to FIGS. 1 to 12, a first example valve train assembly 1 comprises dual body rocker arms 3*a* (hereinafter, simply, rocker arms) for controlling intake valves 40*a*, and rocker arms 3*b* for controlling exhaust valves 40*b*, of cylinders of an internal combustion engine. The valve train assembly 1 is for an inline-four (I-4) internal combustion engine having four cylinders. There are a total of eight intake valves 40*a*, two for each cylinder, and eight exhaust valves 40*b*, again, two for each cylinder.

The valve train assembly 1 comprises a first cam shaft 44*a* comprising cams 43*a*, one for each intake valve 40*a*, and a second cam shaft 44*b* comprising cams 43*b*, one for each exhaust valve 40*b*. Each cam 43*a*, 43*b* comprises a base circle 43*a*', 43*b*' and a lift profile 43*a*", 43*b*". The lift profiles 43*a*" of the first cam shaft 44*a* are arranged to cause opening of the respective intake valves 40*a*, via the rocker arms 3*a*, at the appropriate times in the engine cycle. Similarly, lift profiles 43*b*" of the second cam shaft 44*b* are arranged to cause opening of the respective exhaust valves 40*b*, via the rocker arms 3*b*, at the appropriate times in the engine cycle.

The valve train assembly 1 comprises an actuation arrangement 100. In broad overview, the actuation arrangement 100 is arranged to control the rocker arms 3*a*, 3*b* to provide either a first valve-lift mode, or a second valve-lift mode.

Figure 6:
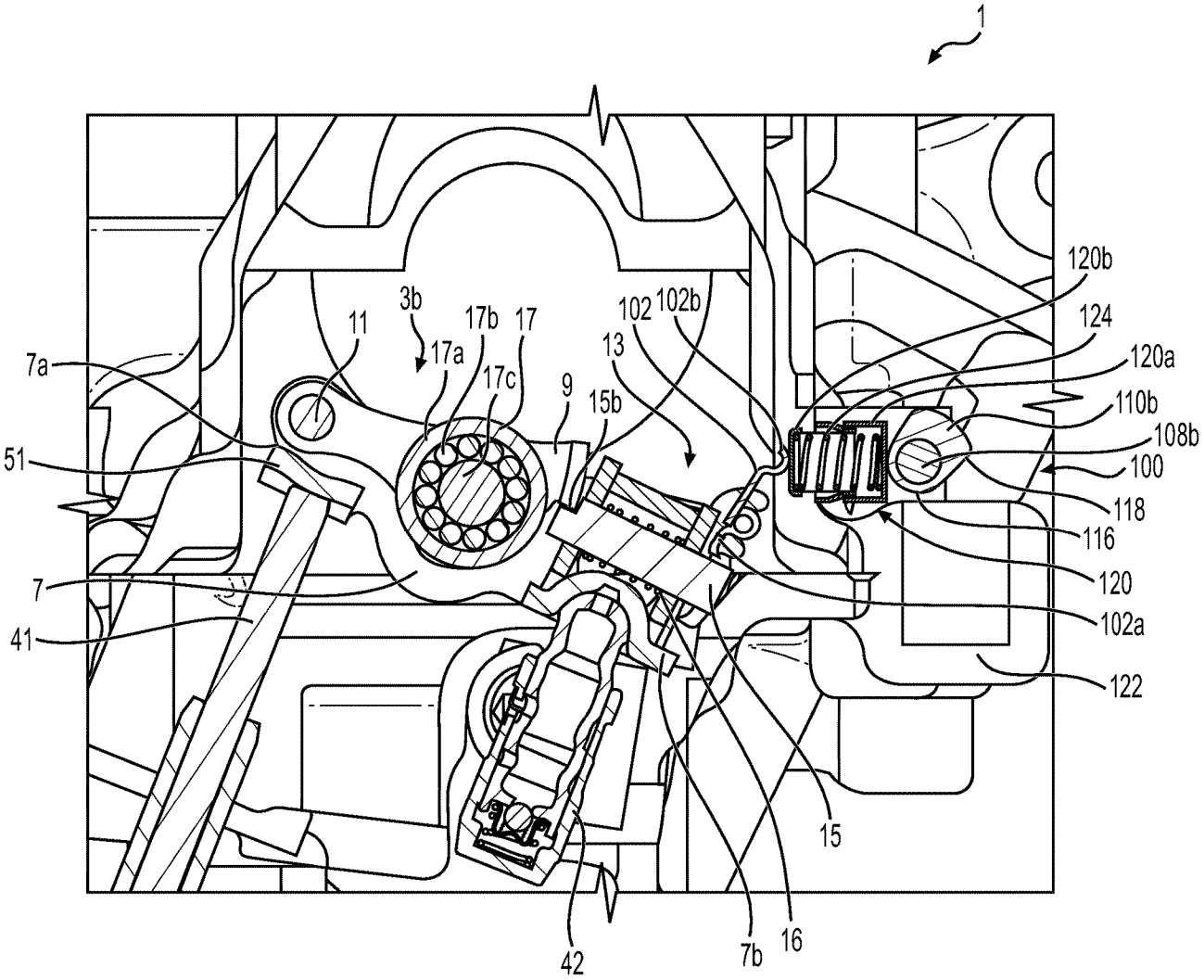
FIG. 6 illustrates schematically a detail of the sectional view of FIG. 5.
Figure 7:
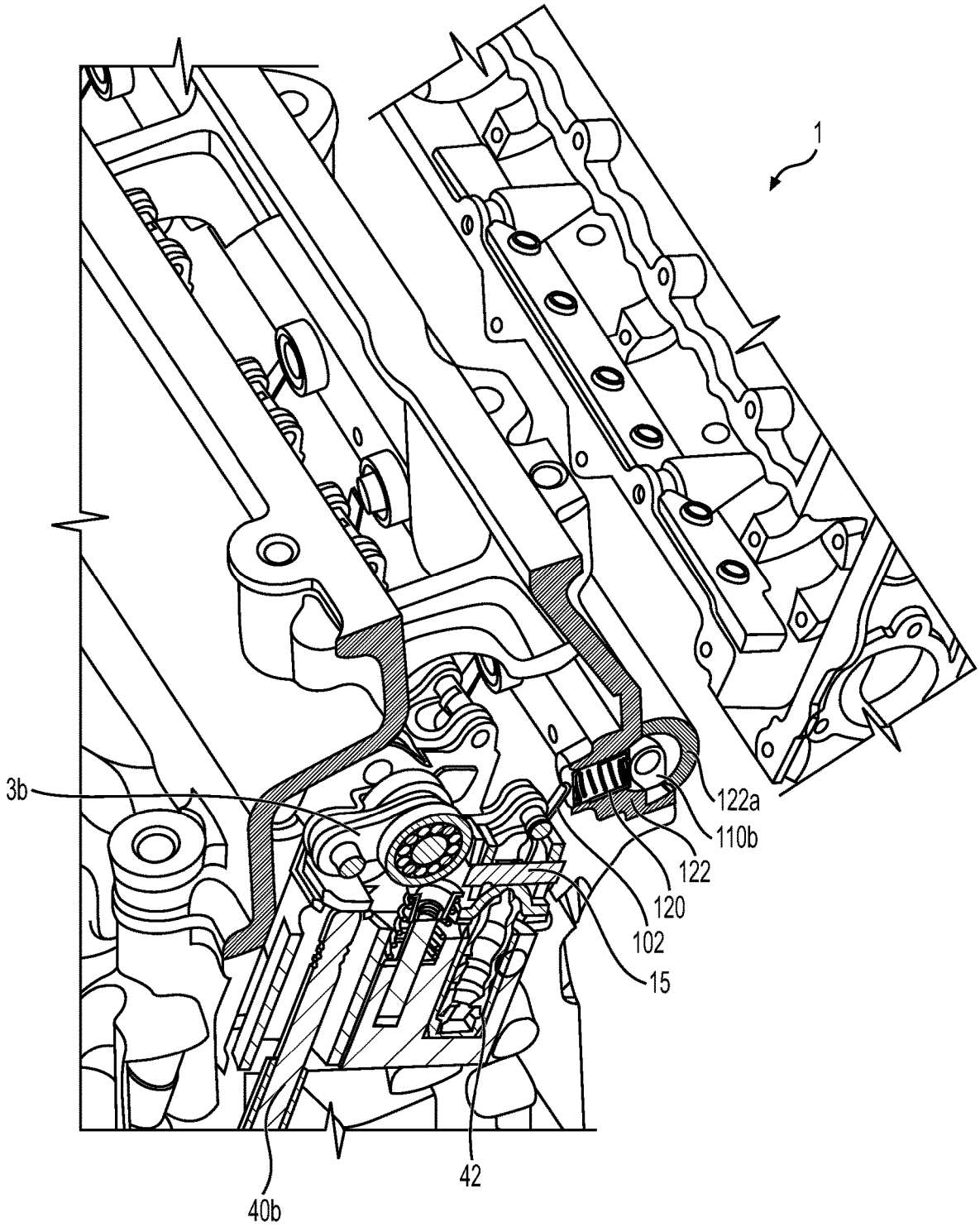
FIG. 7 illustrates schematically a perspective cutaway view of a valve train assembly according to a first example.
Figure 8:
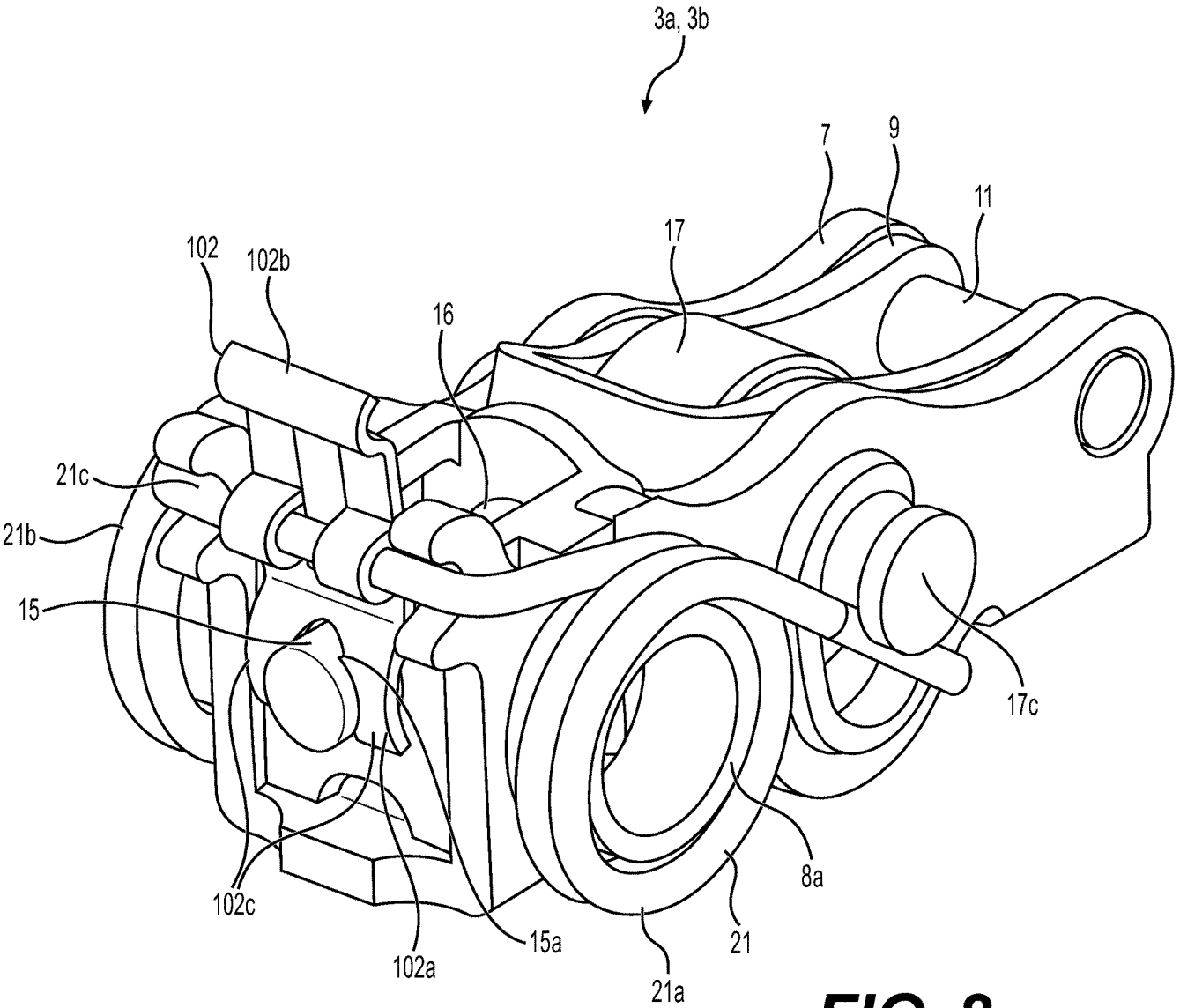
FIG. 8 illustrates schematically a perspective view of a dual body rocker arm according to an example.
Figure 9:
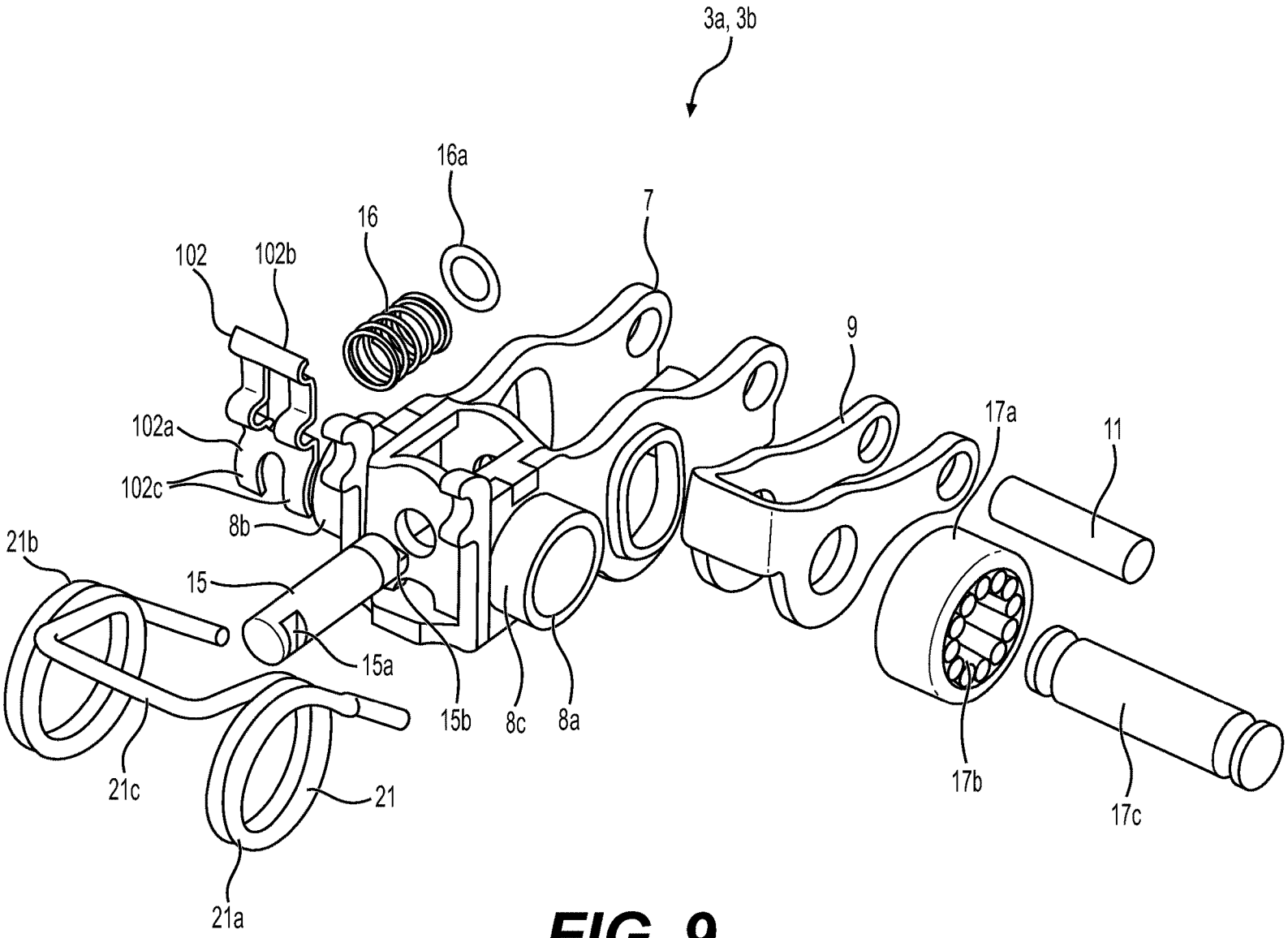
FIG. 9 illustrates schematically an exploded view of a dual body rocker arm of FIG. 8.

As more clearly seen in FIGS. 6, 8 and 9, each rocker arm 3*a*, 3*b* comprises an outer body 7 and an inner body 9 that are pivotably connected together at a pivot axis 11. A first end 7*a* of the outer body 7 contacts a valve stem 41*a*, 41*b* of the valve 40*a*, 40*b* and a second end 7*b* of the outer body 7 contacts a hydraulic lash adjuster (HLA) 42. The HLA 42 compensates for lash in the valve train assembly 1. The outer body 7 is arranged to move or pivot about the HLA 42. The outer body 7 contacts the valve stem 41 *a*, 41*b* via a foot portion 51. Each rocker arm 3*a*, 3*b* further comprises at the second end 7*b* of the outer body 7*a* latching arrangement 13 comprising a latch pin latch pin 15 that can be urged between a first position in which the outer body 7 and the inner body 9 are latched together and hence can move or pivot about the HLA 42 as a single body, and an second position in which the inner body 9 and the outer body 7 are unlatched and hence can pivot with respect to each other about the pivot axis 11.

Each inner body 9 is provided with an inner body cam follower 17, for example, a roller follower 17 for following the cams 43*a*, 43*b* on the cam shaft 44*a*, 44*b*. The roller follower 17 comprises a roller 17*a* and needle bearings 17*b* mounted on a roller axle 17*c*. Each valve 40*a*, 40*b* comprises a valve spring for urging the rocker arm 3*a*, 3*b* against the cams 43*a*, 43*b* of the cam shaft 44.

Each rocker arm further comprises a return spring arrangement 21 for returning the inner body 9 to its rest position after it is has pivoted with respect to the outer body 7. The return spring 21 is a torsional spring supported by the outer body 7.

When the latch pin 15 of a rocker arm 3*a*, 3*b* is in the latched position (as per e.g. FIG. 6), that rocker arm 3*a*, 3*b* provides a first primary function, for example, the valve 40*a*, 40*b* it controls is activated as a result of the rocker arm 3*a*, 3*b* pivoting as a whole about the HLA 42 and exerting an opening force on the valve 40*a*, 40*b* it controls. For example, when the latch pin of the rocker arm 3*a* is in the latched position, and hence the inner body 9 and the outer body 7 are latched together, when the cam shaft 44*a*, 44*b* rotates such that the lift profile 43*a*", 43*b*" of the cam 43*a*, 43*b* engages the inner body cam follower 17, the rocker arm 3*a* is caused to pivot about the HLA 42 against the valve spring, and hence control the valve 40*a* to open.

When the latch pin 15 of a rocker arm 3*a*, 3*b* is in the un-latched position, that rocker arm 3*a*, 3*b* provides a second secondary function, for example, the valve 40*a*, 40*b* it controls is de-activated as a result of lost motion absorbed by the inner body 9 pivoting freely with respect to the outer body 7 about the pivot axis 11 and hence no opening force being applied to the valve 40*a*, 40*b*. For example, when the latch pin 15 of the rocker arm 3*a* is in the un-latched position, and hence the inner body 9 and the outer body 7 are unlatched, when the cam shaft 44 rotates such that the lift profile 43*a*", 43*b*" of the cam 43, 44 engages the inner body cam follower 17, the inner body 9 is caused to pivot with respect to the outer body 7 about the pivot axis 11 against the return spring arrangement 21, and hence the rocker arm 3*a* is not caused to pivot about the HLA 42, and hence the valve 40*a*, 40*b* does not open. The cylinder associated with the valve 40*a* may thereby be deactivated (also referred to as cylinder deactivation).

In such a way, for example, the position of the latch pin may be used to control whether or not the rocker arm 3*a*, 3*b* is configured for cylinder deactivation.

As mentioned above, the rocker arm 3*a*, 3*b* comprises the inner body 9, the outer body 7, and the latching arrangement 13 moveable to latch and unlatch the inner body 9 and the outer body 7. The latching arrangement 13 is at an opposite side of the rocker arm 3*a*, 3*b* to the pivot axis 11. The latching arrangement 13 comprises the latch pin 15 moveable between a first position in which the latch pin 15 latches the inner body 9 and the outer body 7 together and a second position in which the inner body 9 and the outer body 9 are un-latched. The latching arrangement 13 comprises a lever 102 mounted for pivotal motion relative to the outer body 7. A first end 102*a* of the lever 102 contacts the latch pin 15, and a second end 10*b* of the lever 102 is for contacting the actuation arrangement 100. In broad overview, when the actuation arrangement 100 exerts a force on the second end 102*b* of the lever, the lever 102 is caused to pivot such that the first end 102*a* of the lever exerts a force on the latch pin 15, thereby moving the latch pin from the first (latched) position to the second (unlatched) position.

The lever 102 is arranged to orient the latch pin 15 rotationally with respect to the outer body 7. Specifically, as best seen in FIGS. 8 and 9, the second end 102*b* of the lever 102 defines protrusions 102*c*, and the latch pin 15 defines transverse slots 15*a* into which the protrusion 102*c* is received. This prevents the latch pin 15 from rotating relative to the lever 102, and thereby orients the latch pin 15 rotationally with respect to the lever 102. Specifically, the latch pin 15 is orientated so that a shelf 15*b* of the latch pin 15 for engaging with the inner body 9 when the latch pin 15 is in the first position, faces towards the inner body 9.

As mentioned above, the rocker arm 3*a*, 3*b* comprises a torsional biasing device or spring 21 supported by the outer body 7 and arranged to bias the inner body 9 relative to the outer body 7. As best seen in FIGS. 8 and 9, the torsional spring 21 (also known as a torsional lost motion spring) comprises two coiled sections 21*a*, 21*b* arranged around and supported by protrusions 8*a*, 8*b* on opposite sides of the outer body 7, and a non-coiled section 21*c* joining the two coiled sections, 21*a*, 21*b* and extending transversely across the outer body 7. The lever 102 is mounted on the non-coiled section 21*c* of the torsional biasing device 21, for pivotal motion relative to the first body 7. The lever 102 is mounted on the non-coiled section 21*c* of the torsional spring 21 at a point along the lever 102 between the first end 102*a* and the second end 102*b* of the lever 102. The lever 102 converts a pushing force on the first end 102*a* of the lever into a force that pulls the latch pin 15 away from the inner body 9, thereby to move the latch pin 15 from the first (latched) position to the second (unlatched) position.

The latching arrangement 13 comprises a biasing element or return spring 16 arranged to bias the latch pin 15 towards the first position. As a result, the default configuration of the rocker arm 3*a*, 3*b* is that the inner body 9 and the outer body 7 are latched together to provide the first primary function. The rocker arm 3*a* is arranged such that an actuation arrangement 100 can cause the latch pin 15 to move from the first position to the second position against the return spring 16. The return spring 16 has an associated washer 16*a*.

As mentioned above, the outer body 7 comprises protrusions 8*a*, 8*b* to support the torsional spring 21. The protrusions 8*a*, 8*b* are formed integrally with the outer body 7. More specifically the protrusions 8*a*, 8*b* are formed from the outer body 7. For example, the protrusions 8*a*, 8*b* and the outer body 8 are formed from a single sheet of material, such as metal. For example, the protrusions 8*a*, 8*b* and the outer body 7 are formed from a stamped metal sheet. For example, a method of manufacturing the rocker arm 3*a*, 3*b* may comprise providing a sheet of material; and stamping the sheet of material to form the protrusions 8*a*, 8*b*. The inner body 9 may also be metal sheet stamped.

The torsional spring 21 is arranged to bias the inner body 9 relative to the outer body 7 from a position in which the inner body 9 is pivoted away from the outer body 7, towards a position in which the inner body 9 is aligned with the outer body 9. The torsional biasing device 21 is arranged around each protrusion 8*a*, 8*b*. Specifically, each protrusion 8*a*, 8*b* comprises a substantially cylindrical cuff 8*a*, 8*b*, the cuff 8*a*, 8*b* defining a curved surface 8*c* by which the torsional biasing device 21 is supported. Each protrusion 8*a*, 8*b* is located towards an end 7*b* of the outer body 7 opposite to that end 7*a* where the inner body 9 is connected to the outer body 7.

As mentioned above, the actuation arrangement 100 controls the latching arrangement 13 of the rocker arms 3*a*, 3*b*, so as to control the position of the latch pins 15, so as to control whether or not the rocker arms 3*a*, 3*b* are configured for cylinder deactivation.

As best seen in FIGS. 1 to 4, the actuation arrangement 100 comprises an actuation source 104, and an actuation transmission arrangement 106. The actuation arrangement 100 is incorporated in the cam carrier 122 of the engine. The actuation transmission arrangement 106 is arranged to transmit movement of the actuation source 104 to the latching arrangements 13 of the rocker arms 3*a*, 3*b* of both the intake valves 40*a* and the exhaust valves 40*b*. In other words, the actuation source 104 is common to the latching arrangements 13 of the rocker arms 3*a*, 3*b* of both the intake valves 40*a* and the exhaust valves 40*b*. In broad overview, in use, movement of the actuation source 104 causes, via the actuation transmission arrangement 106, control of the latching arrangements 13 of the exhaust valve and intake valve rocker arms 3*a*, 3*b*, in common.

The actuation transmission arrangement 106 comprises a first shaft 108*a* comprising a first set of cams 110*a* for controlling the latching arrangements 13 of the rocker arms 3*a* controlling the intake valves 40*a*. The actuation transmission arrangement 106 comprises a second shaft 108*b* comprising a second set of cams 110*b* for controlling the latching arrangements 13 of the rocker arms 3*b* controlling the exhaust valves 40*b*. The actuation source 104 is common to the first shaft 108*a* and the second shaft 108*b*. The axis of the rotation of the actuation 104 source is perpendicular to an axis of rotation of the first shaft 108*a* and to an axis of rotation of the second shaft 108*b*. In use, a rotation of the actuation source 104 causes, via gear mechanisms 112*a*, 112*b*, the first shaft 108*a* and the second shaft 108*b* to rotate, thereby to change an orientation of the first set of cams 110*a* and the second set of cams 110*b* relative the latching arrangements 13 of the rocker arms 3*a*, 3*b* of the intake valves 40*a* and the exhaust valves 40*b*, respectively, so as to control those latching arrangements 13.

As best seen in FIG. 6, each cam 110 has an associated compliance arrangement 120 intermediate of the cam 110 and the latching arrangement 13 of the associated rocker arm 3*a*, 3*b*. The compliance arrangement 120 is supported by a main body 122 external to the rocker arm 3*a*,3*b*. Specifically, the compliance arrangement 120 is supported by the cam carrier 122. The shafts 108*a*, 108*b* and cams 110*a*, 110*b* are housed in a housing 122*a* connected to the cam carrier 122 adjacent to the compliance arrangement 120 (see also FIG. 7). The compliance arrangement 120 comprises a first portion 120*a* for contacting with the cam 110, a second portion 120*b* for contacting with the latching arrangement 13. The second portion 120*b* is moveable relative to the first portion 120*a*. The compliance arrangement comprises a biasing element 124 arranged to bias the first portion 120*a* and the second portion 120*b* away from one another. The compliance device 120 transmits an actuation force from the cam 110 to the latching arrangement 13 of the rocker arm.

Each cam 110 has a base circle 116 and a raised profile 118. When the cam 110 is orientated such that the base circle 116 is engaged with the compliance arrangement 120, no actuation force is transmitted to the latching arrangement 13, and hence the rocker arm 3*a*, 3*b* remains in its default, latched configuration. When the shaft 108 is rotated such that the raised profile 118 is engaged with the compliance arrangement 120, the raised profile 118 applies a force, via the compliance arrangement 120, to the latching arrangement 13. If the latching arrangement 13 is free to move, this force will cause the latch pin 15 to move from its first, default position to its second position in which the inner body 9 and the outer body 7 are unlatched, and hence in a cylinder deactivation configuration. However, if the latching arrangement 13 is in a non-moveable state, the biasing element 124 becomes biased by the cam 110, and the biasing element 124 causes the latching arrangement 13 to move from its first position to its second position when the latching arrangement 13 is in a moveable state again. For example, the latching arrangement 13 may be in a non-moveable state when the engine cycle is such that the inner body 9 is forced against the latch pin 15 so as to hold it firmly in place. The biasing element 124 if biased by the cam 110 in this time will then, once the engine cycle has moved on such that the inner body 9 is no longer forced against the latch pin 15, cause the latch pin 15 to move from the first position to the second position, and hence configure the rocker arm 3*a*, 3*b* for cylinder deactivation. The compliance arrangement 120 thereby allows for the actuation of the latching arrangement to be effected as soon as it is physically possible, and hence can simplify timing requirements of actuating the latching arrangements 13.

Figure 3:
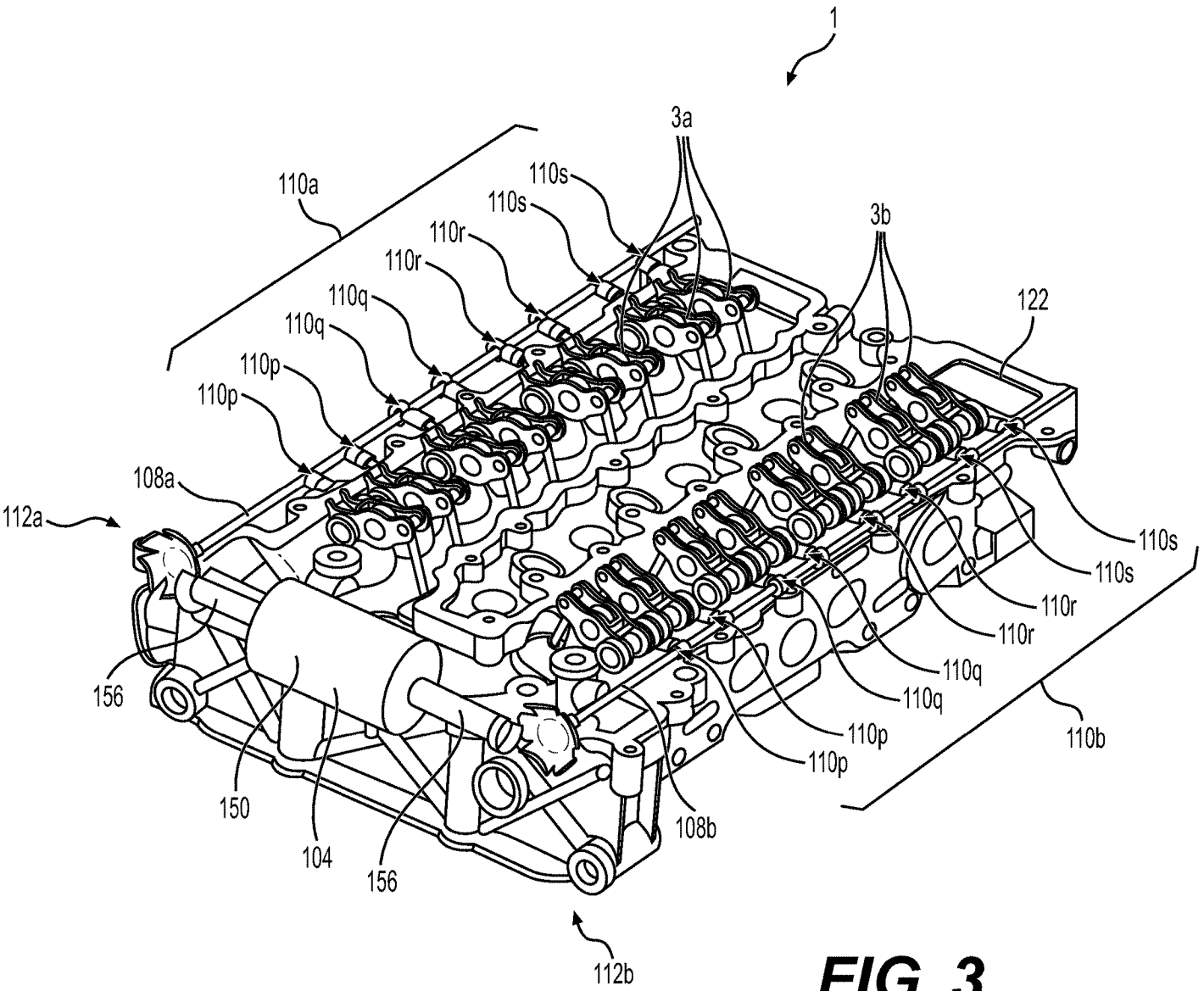
FIG. 3 illustrates schematically a perspective view of a valve train assembly according to the first example.
Figure 4:
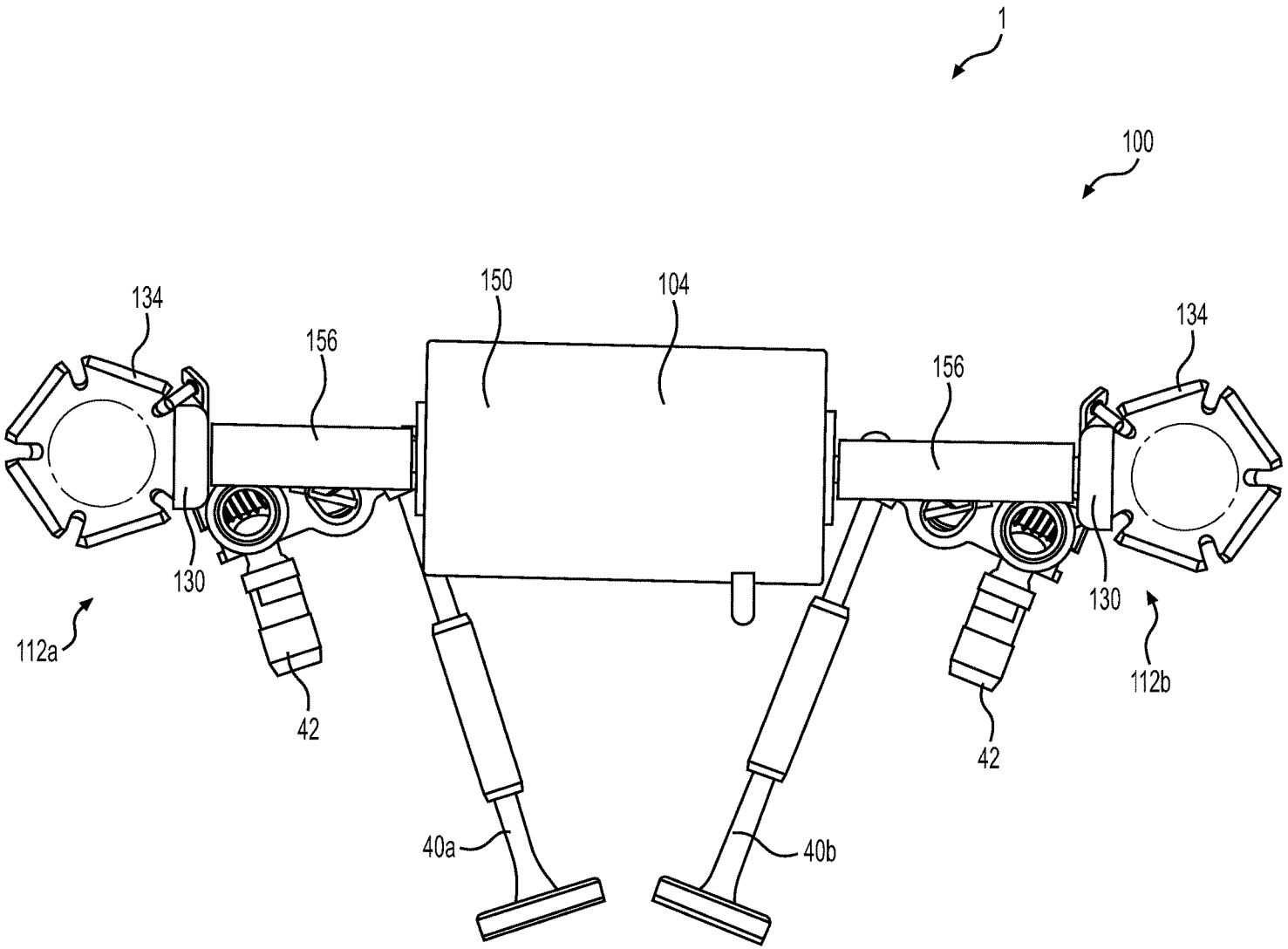
FIG. 4 illustrates schematically a side view of a valve train assembly according to the first example.
Figure 5:
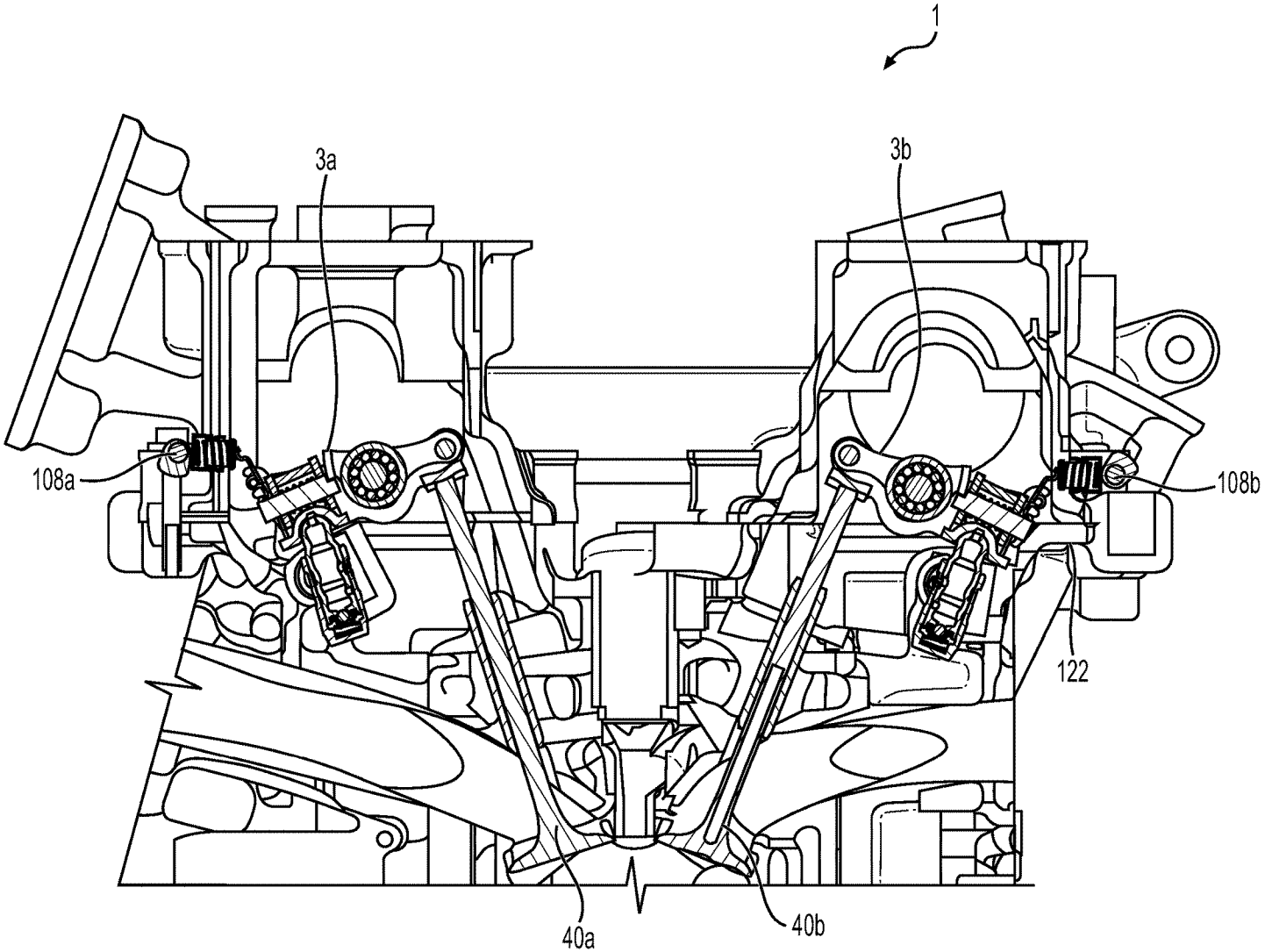
FIG. 5 illustrates schematically a sectional view of a valve train assembly according to the first example.

As best seen in FIG. 3, the cams 110 of the first set of cams 110*a* have different shapes to allow control of the latching arrangements 13 on a per cylinder basis. Similarly, the cams 110 of the second set of cams 110*b* have different shapes to allow control on a per cylinder basis. The cams 110 of the first set 110*a* and the second set 110*b* that are associated with the same cylinder have the same shape, so as to allow for deactivation of that cylinder based on deactivation of both the intake and exhaust valves of that cylinder.

Specifically, first cams 11 Op for controlling rocker arms 3*a*, 3*b* of valves 40*a*, 40*b* of a first cylinder have a first shape, second cams 1 lOq for controlling rocker arms 3*a*, 3*b* of valves 40*a*, 40*b* of a second cylinder have a second shape, third cams 1 lOr for controlling rocker arms 3*a*, 3*b* of valves

40*a*, 40*b* of a third cylinder have a third shape, and fourth cams 110*s* for controlling rocker arms 3*a*, 3*b* of valves 40*a*, 40*b* of a fourth cylinder have a fourth shape.

Figure 10:
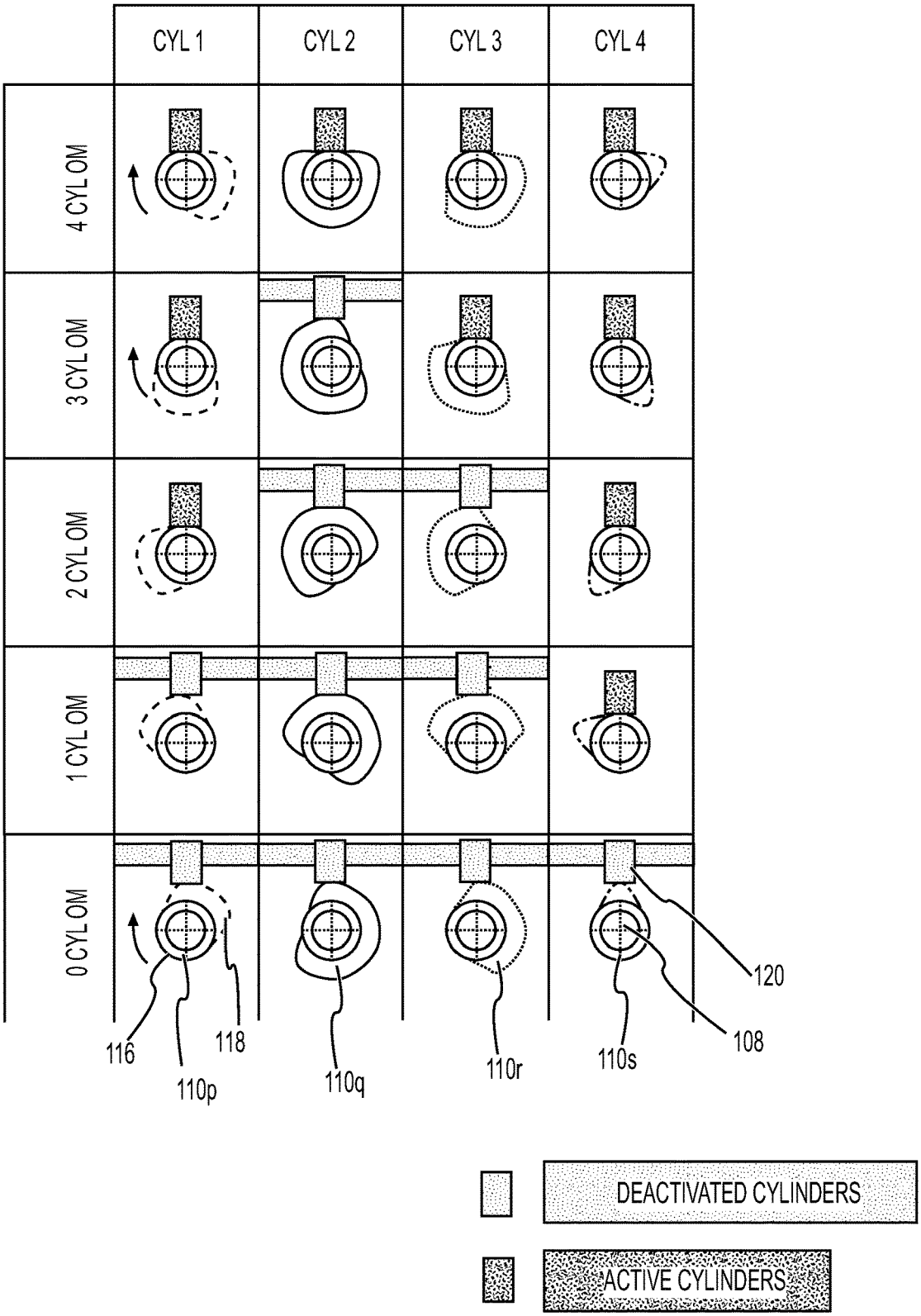
FIG. 10 illustrates schematically a table of different cylinder operating modes for different cam orientations.

As best seen in FIG. 10, the shapes of the different cams 11 Op, HOq, 11 Or, 110*s* are different in that the raised profile 118 extends over different proportions of the circumference of the different cams 1 lOp, 1 lOq, 1 lOr, 110*s*. The different shaped cams 110 are phased relative to one another with respect to the shaft 108. The table of FIG. 10 shows the orientation of the four different shaped cams 11 Op, HOq, 11 Or, 1 is, associated with the cylinders CYL1, CYL2, CYL3, CYL4 respectively, relative to the compliance arrangement 120 (indicated in FIG. 10 by a hatched rectangle), and hence latching arrangement 13, at five different rotational positions of the shaft 108 to which the cams are attached.

In the first row of the table of FIG. 10, the shaft 108 is rotated such that all of the cams 11 Op, HOq, 11 Or, 110*s* have their base circles 116 engaged with the compliance arrangements 120. Hence no force will be applied to the latching arrangements 13 of any of the rocker arms 3*a*, 3*b*, and hence all of the rocker arms 3*a*, 3*b* will be in their default, latched, configuration, and hence all will be providing their first primary function, and hence all the cylinders CYL1, CYL2, CYL3, CYL4 will be active. The engine will therefore be operating in a 4 cylinder operational mode.

In the second row of the table of FIG. 10, the shaft 108 is rotated by a fifth of a turn (i.e. by 72°) clockwise in the sense of FIG. 10 as compared to the first row, such that the first cam 1 lOp, third cam 1 lOr, and fourth cam 110*s* still have their base circles 116 engaged with the compliance arrangements 120, but the second cam HOq has its raised profile 118 engaged with its compliance arrangement 120. Hence an actuation force will be applied only to the latching arrangements 13 of the rocker arms 3*a*, 3*b* of the second cylinder CYL 2, and hence only those rocker arms 3*a*, 3*b* will be actuated to be in their unlatched state, and hence only those rocker arms 3*a*, 3*b* will provide their second secondary function of providing cylinder deactivation, and hence only the second cylinder C YL2 will be deactivated (indicated in FIG. 10 by a hatched bar extending across the width of the associated cell), whereas the first, third and fourth cylinders CYL1, CYL3, CYL4 will remain active. The engine will therefore be operating in a 3 cylinder operational mode.

In the third row of the table of FIG. 10, the shaft 108 is rotated by a fifth of a turn (i.e. by 72°) clockwise in the sense of FIG. 10 as compared to the second row, such that the first cam 11 Op and fourth cam 110*s* still have their base circles 116 engaged with their compliance arrangements 120, but the second cam HOq and third cam 11 Or have their raised profile 118 engaged with their compliance arrangements 120. Hence an actuation force will be applied only to the latching arrangements 13 of the rocker arms 3*a*, 3*b* of the second cylinder CYL 2 and the third cylinder CYL3, and hence only those rocker arms 3*a*, 3*b* will be actuated to be in their unlatched state, and hence only those rocker arms 3*a*, 3*b* will provide their second secondary function of providing cylinder deactivation, and hence only the second cylinder C YL2 and the third cylinder CYL3 will be deactivated (indicated in FIG. 10 by a hatched bar extending across the width of the associated cells), whereas the first and fourth cylinders CYL1, CYL4 will remain active. The engine will therefore be operating in a 2 cylinder operational mode.

In the fourth row of the table of FIG. 10, the shaft 108 is rotated by a fifth of a turn (i.e. by 72°) clockwise in the sense of FIG. 10 as compared to the third row, such that only the fourth cam 110*s* still has its base circle 116 engaged with its compliance arrangement 120, but the first cam 1 lOp, second cam 1 lOq and third cam 11 Or have their raised profile 118 engaged with their compliance arrangements 120. Hence an actuation force will be applied to the latching arrangements 13 of the rocker arms 3*a*, 3*b* of the first cylinder CYL1, second cylinder CYL 2 and the third cylinder CYL3, and hence those rocker arms 3*a*, 3*b* will be actuated to be in their unlatched state, and hence those rocker arms 3*a*, 3*b* will provide their second secondary function of providing cylinder deactivation, and hence the first cylinder CYL1, second cylinder CYL2 and the third cylinder CYL3 will be deactivated (indicated in FIG. 10 by a hatched bar extending across the width of the associated cells), whereas the fourth cylinder CYL4 will remain active. The engine will therefore be operating in a 1 cylinder operational mode.

In the fifth row of the table of FIG. 10, the shaft 108 is rotated by a fifth of a turn (i.e. by 72°) clockwise in the sense of FIG. 10 as compared to the fourth row, such that all of the first cam 1 lOp, second cam 1 lOq, third cam 1 lOr and fourth cam 110*s* have their raised profile 118 engaged with their compliance arrangements 120. Hence an actuation force will be applied to the latching arrangements 13 of the rocker arms 3*a*, 3*b* of all of the first cylinder CYL1, second cylinder CYL 2, third cylinder CYL3, and the fourth cylinder CYL4, and hence all of the rocker arms 3*a*, 3*b* will be actuated to be in their unlatched state, and hence the rocker arms 3*a*, 3*b* will provide their second secondary function of providing cylinder deactivation, and hence all of the first cylinder CYL1, second cylinder CYL2, third cylinder CYL3, and the fourth cylinder CYL4 will be deactivated (indicated in FIG. 10 by a hatched bar extending across the width of all of the cells). The engine will therefore be operating in a 0 cylinder operational mode, and in effect will be shut off. Further rotation of the shaft 108 by a fifth of a turn (i.e. by 72°) clockwise in the sense of FIG. 10 would return the shaft and cams 110 to the orientation illustrated in the first row of the table of FIG. 10, and hence return the engine to a 4 cylinder operational mode again.

Figure 11:
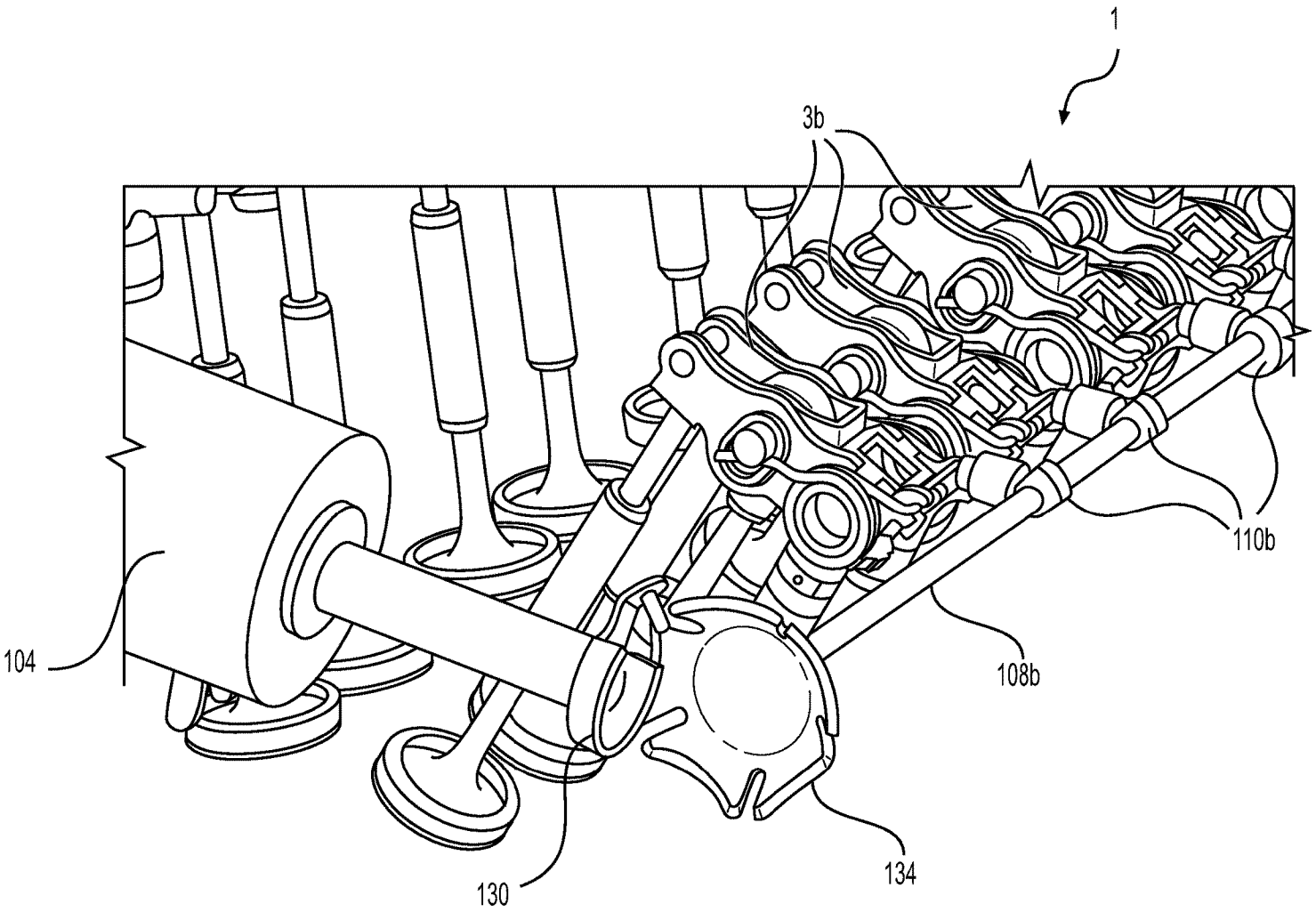
FIG. 11 illustrates schematically a detail of a perspective view of the valve train assembly according to the first example.
Figure 12:
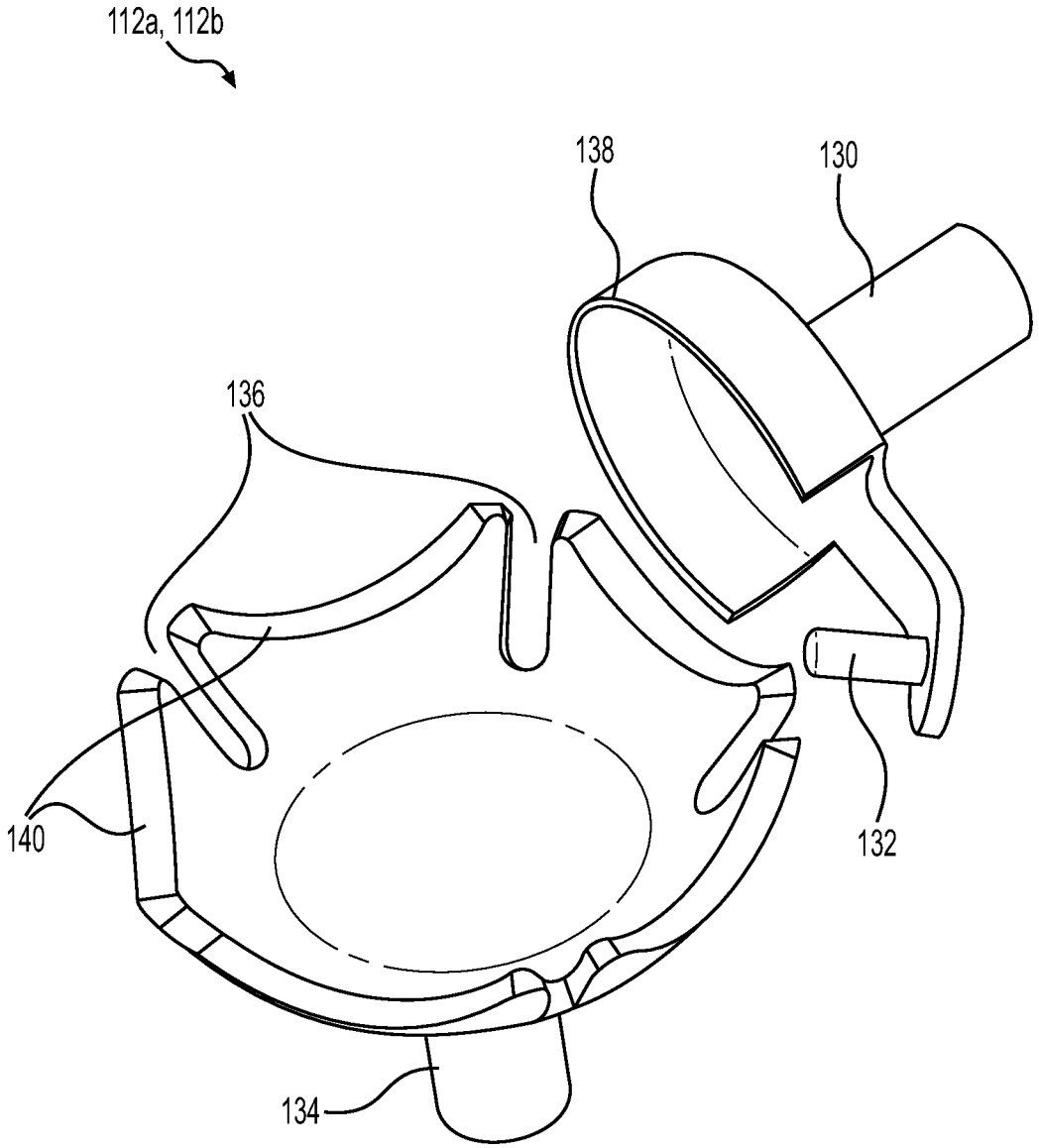
FIG. 12 illustrates schematically a perspective view of a gear mechanism according to an example.

As mentioned above, a rotation of the actuation source 104 causes, via gear mechanisms 112*a*, 112*b*, the first shaft 108*a* and the second shaft 108*b* to rotate, so as to control the latching arrangements 13 of the rocker arms 3*a*, 3*b*, for example using cams 110 as described above. As best seen in FIGS. 11 and 12, a gear mechanism 112*a*, 112*b* is arranged to translate a continuous rotation of the actuation source 104 into an intermittent rotation of the shaft 108*a*, 108*b* in steps of a predefined degree. In use, a continuous rotation of the actuation source 104 causes, via the gear mechanism 112*a*, 12*b*, the shaft 108*a*, 108*b* to rotate in steps of a predefined degree, thereby to change an orientation of the cams 110 relative the latching arrangements 13 by a predefined amount, so as to control the latching arrangements 13. Specifically, the gear mechanism 112*a*, 112*b* is arranged to translate the continuous rotation of the actuation source 104 into an intermittent rotation of the shaft 108*a*, 108*b* in steps of 72°, either clockwise or anticlockwise. This allows, as described above, sequential selection of the operational mode of the engine from 0 cylinders to 1 or 4 cylinders, from 1 cylinder to 0 or 2 cylinders, from 2 cylinders to 3 or 1 cylinders, from 3 cylinders to 4 or two cylinders, and from 4 cylinders to 3 or 0 cylinders.

The gear mechanism 112*a*, 112*b* is arranged to prevent rotation of the shaft 108*a*, 108*b* between the intermittent rotations of the shaft 108*a*, 108*b*. This allows the shaft 108*a*, 108*b* to be held in position, and hence the operational mode selection to remain effective, without the gear mechanism 112*a*, 112*b* or other component needing to absorb a holding force.

The gear mechanism 112*a*, 112*b*, is a "Malta's cross" type gear mechanism, also referred to as a "Geneva" type gear mechanism. Specifically, as best seen in FIG. 12, the gear mechanism 112*a*, 112*b* comprises a first part 130 connected to the actuation source 104. The first part 130 comprises a pin 132 distal from the axis of rotation of the first part 130. The gear mechanism 112*a*, 112*b* also comprises a second part 134 connected to the shaft 108. The second part 134 comprises a plurality of slots 136, five as shown, extending radially from the axis of rotation of the second part 134, and into which the pin 132 is engageable. In use, when the actuation source 104 rotates such that the pin 132 engages into one of the slots 136, the pin 132 causes the second part 134 to rotate. This allows the shaft 108*a*, 108*b* to be rotated in discrete steps, thereby to allow discrete selection of the engine operational mode.

The first part 130 comprises an arcuate protrusion 138 protruding substantially parallel with the axis of rotation of the first part 130. The second part 134 comprises an arcuate recess 140 between each of the plurality of slots 136. The arcuate protrusion 138 is engageable with the arcuate recess 140. In use, when the actuation source 104 rotates such that the arcuate protrusion 138 engages with the arcuate recess 140, the arcuate protrusion 138 holds the second part 134 so as to prevent rotation of the second part 134. This allows the shaft 108*a*, 108*b* to be held in position between steps of rotation.

The rotation of the actuation source 104 is substantially perpendicular to an axis of the rotation of the shaft 108*a*, 108*b*. The second part 134 of the gear mechanism 112*a*, 112*b* is therefore concave such that the slots 136 extend at an angle to the plane of rotation of the second part 134. Similarly, the pin 132 of the first part 130 of the gear mechanism 112*a*, 112*b* extends at an angle to the plane of rotation of the first part 130, so as to engage with the correspondingly angled slots 136 of the second part 134. In use, a continuous rotation of the actuation source 104 causes, via the gear mechanisms 112*a*, 112*b*, both the first shaft 108*a* and the second shaft 108*b* to rotate in steps of a common predefined degree, so as to control the respective latching arrangements 13 in common.

Figure 1:
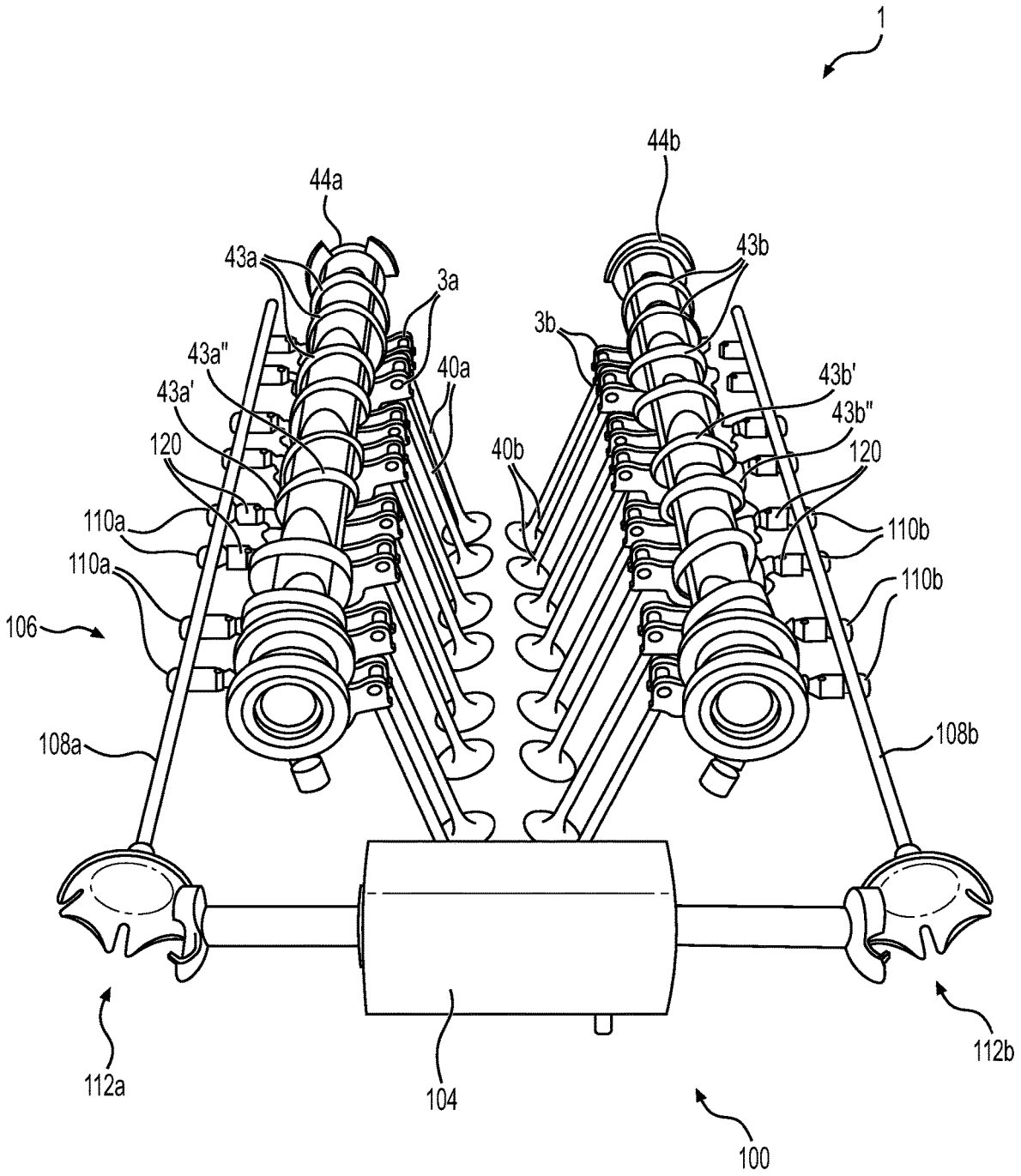
FIG. 1 illustrates schematically a perspective view of a valve train assembly according to a first example.
Figure 2:
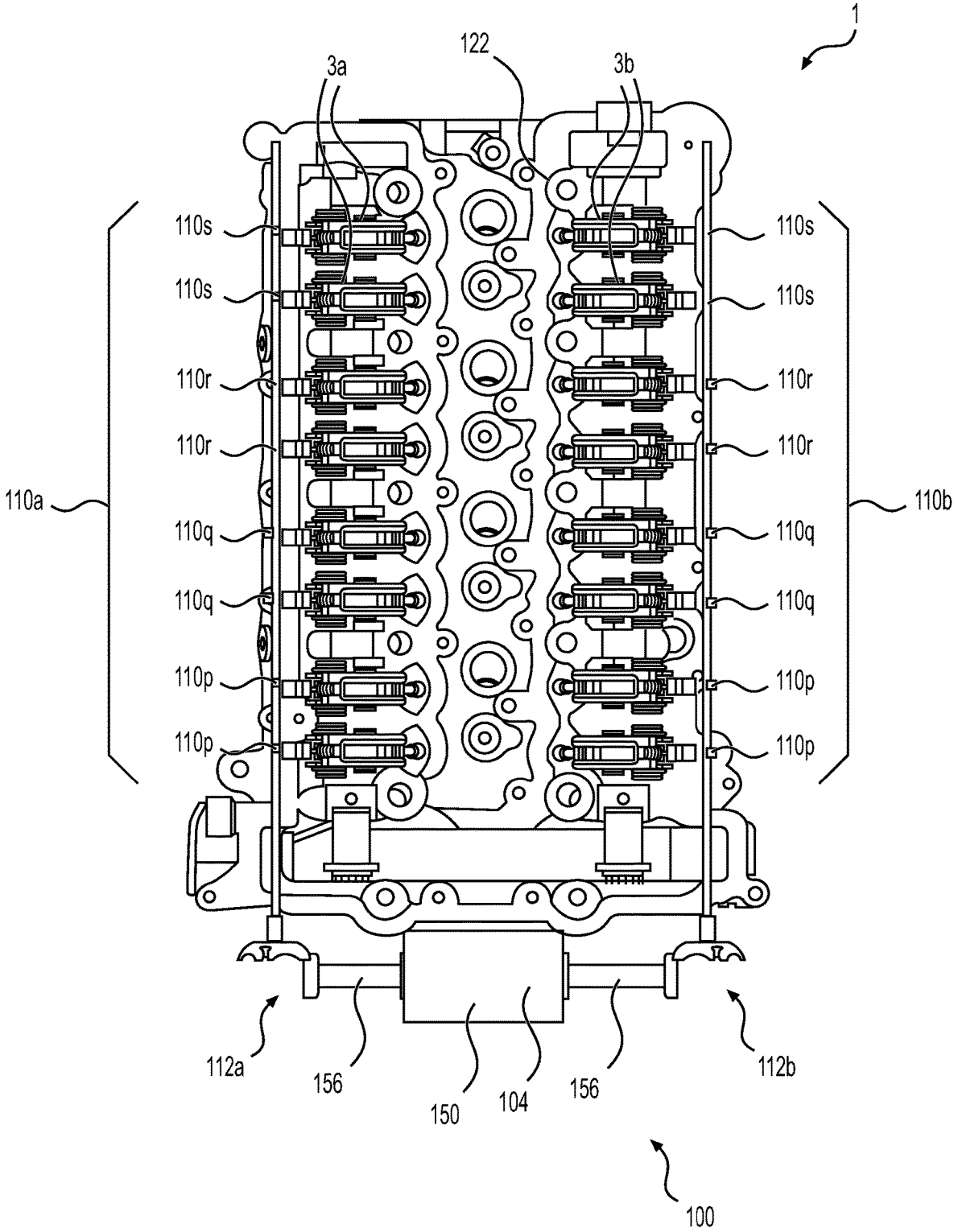
FIG. 2 illustrates schematically a plan view of a valve train assembly according to the first example.

As best seen in FIGS. 2 and 3, the actuation source 104 comprises a rotary electric motor or torque motor 150 comprising an output shaft 156. The rotary electric motor 150 is controllable by a control unit to rotate an output shaft 156. For example, the electric motor 150 may be controlled to rotate the output shaft 156 by a predefined amount depending on the engine operational mode desired to be selected. The output shaft 156 is connected at one end to the first shaft 108*a* via the first gear mechanism 112*a*, and at the other end to the second shaft 108*b* via the second gear mechanism 112*b*. Rotation of the output shaft 156 therefore allows control of the rocker arms 3*a* of the intake valves 40*a* and of the rocker arms 3*b* of the exhaust valves 40*b*. The cams 110*a* and/or the gear mechanism 112*a* of the first shaft 108*a* are phased with the cams 110*b* and/or the gear mechanism 112*b* of the second shaft 108*b* so that a given rotation of the output shaft 156 deactivates or activates the intake valves 40*a* and the exhaust valves 40*b* for a given cylinder at substantially the same time.

Figure 13:
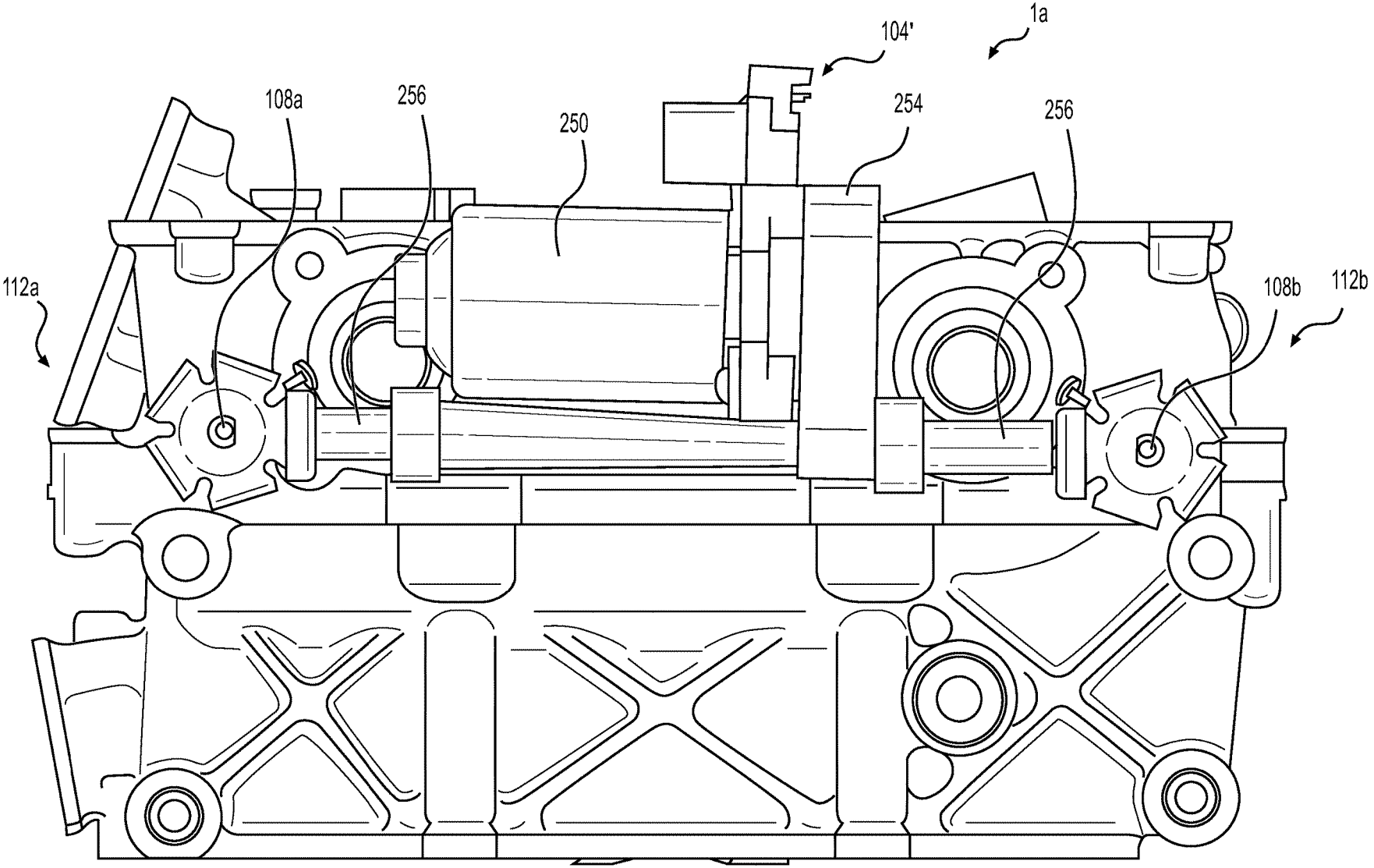
FIG. 13 illustrates schematically a side view of a valve train assembly according to a second example.
Figure 14:
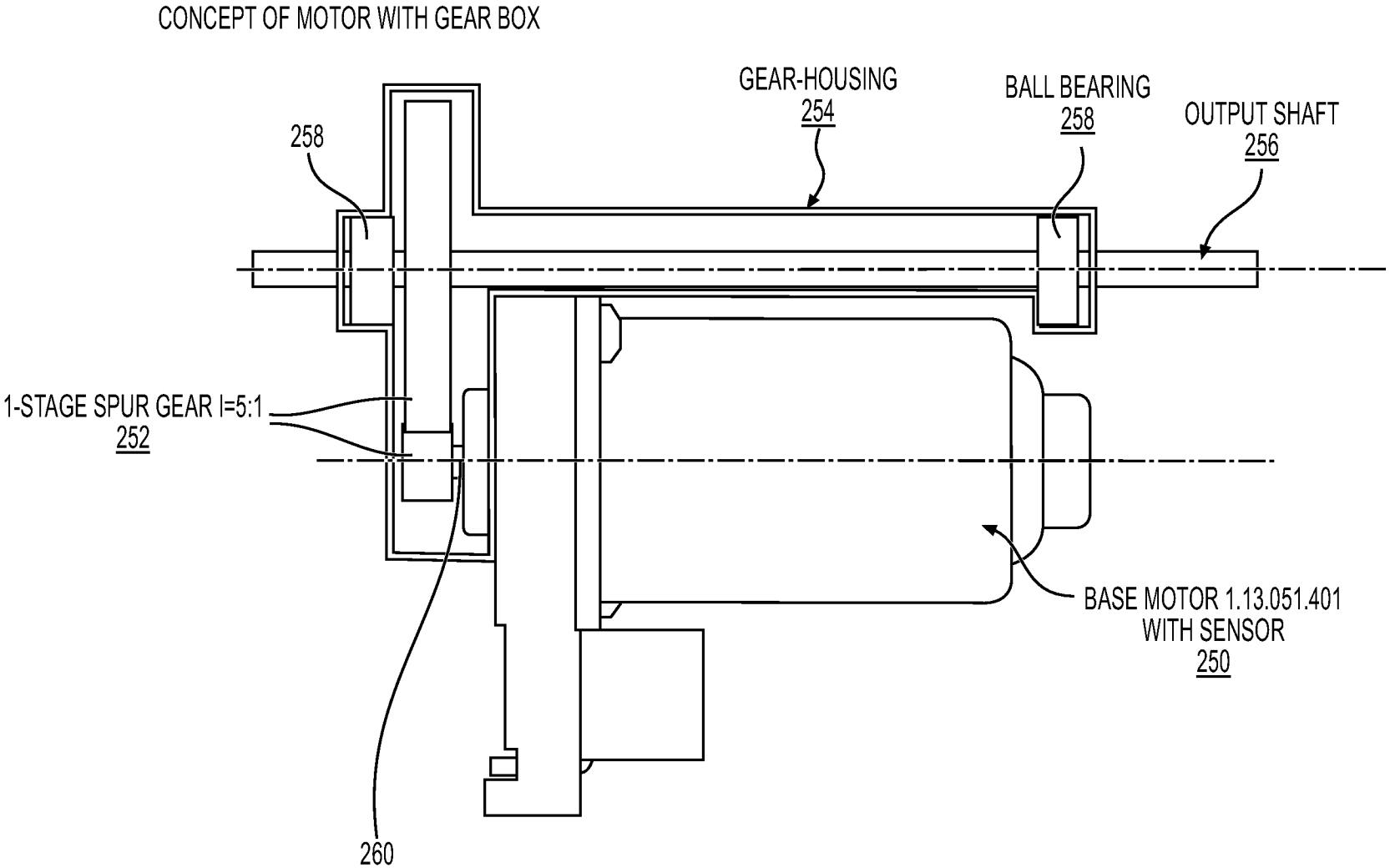
FIG. 14 illustrates schematically a sectional view of an actuation source according to the second example.

A second example is illustrated in FIGS. 13 and 14. This second example may be the same as the first example described above apart from the actuation source 104'. The actuation source 104' in the valve train assembly 1*a* of this second example comprises a rotary electric motor 250, a spur gear 252, a gear housing 254, an output shaft 256, and bearings 258. The output shaft 256 is supported by the bearings 258, which are supported by the gear housing 254. The gear housing 254 houses the spur gear 252. The rotary electric motor 250 is controllable by a control unit to rotate a drive shaft 260. For example, the electric motor may be controlled to rotate the drive shaft 260 by a predefined amount depending on the engine operational mode desired to be selected. Rotation of the drive shaft 260 causes, via the spur gear 252, rotation of the output shaft 256. The output shaft 256 is connected at one end to the first shaft 108*a* via the first gear mechanism 112*a*, and at the other end to the second shaft 108*b* via the second gear mechanism 112*b*. Rotation of the drive shaft 260 therefore allows control of the rocker arms 3*a* of the intake valve 40*a* and of the rocker arms 3*b* of the exhaust valves 40*b*. The cams 110 and/or the gear mechanism 112*a* of the first shaft 108*a* are phased with the cams 110 and/or the gear mechanism 112*b* of the second shaft 108*b* so that a given rotation of the drive shaft 260 deactivates or activates the intake valves 40*a* and the exhaust valves 40*b* for a given cylinder at substantially the same time.

Figure 15:
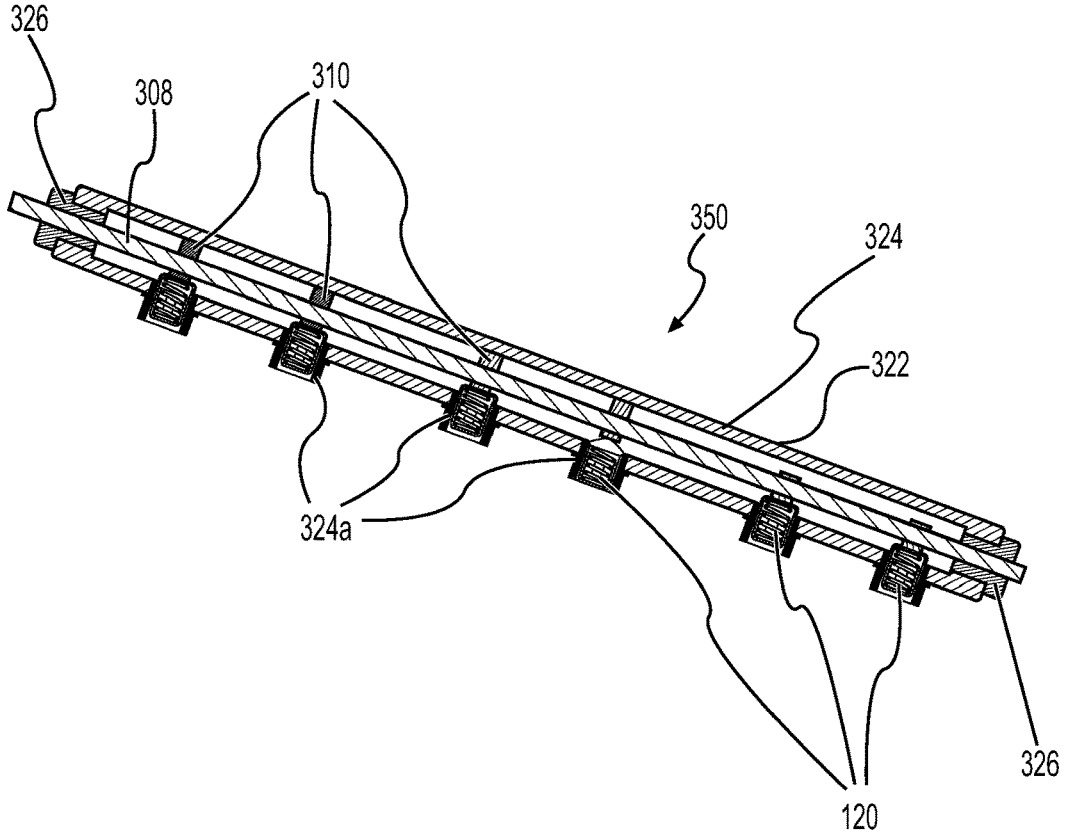
FIG. 15 illustrates schematically a sectional view of an actuation assembly according to a third example.
Figure 16:
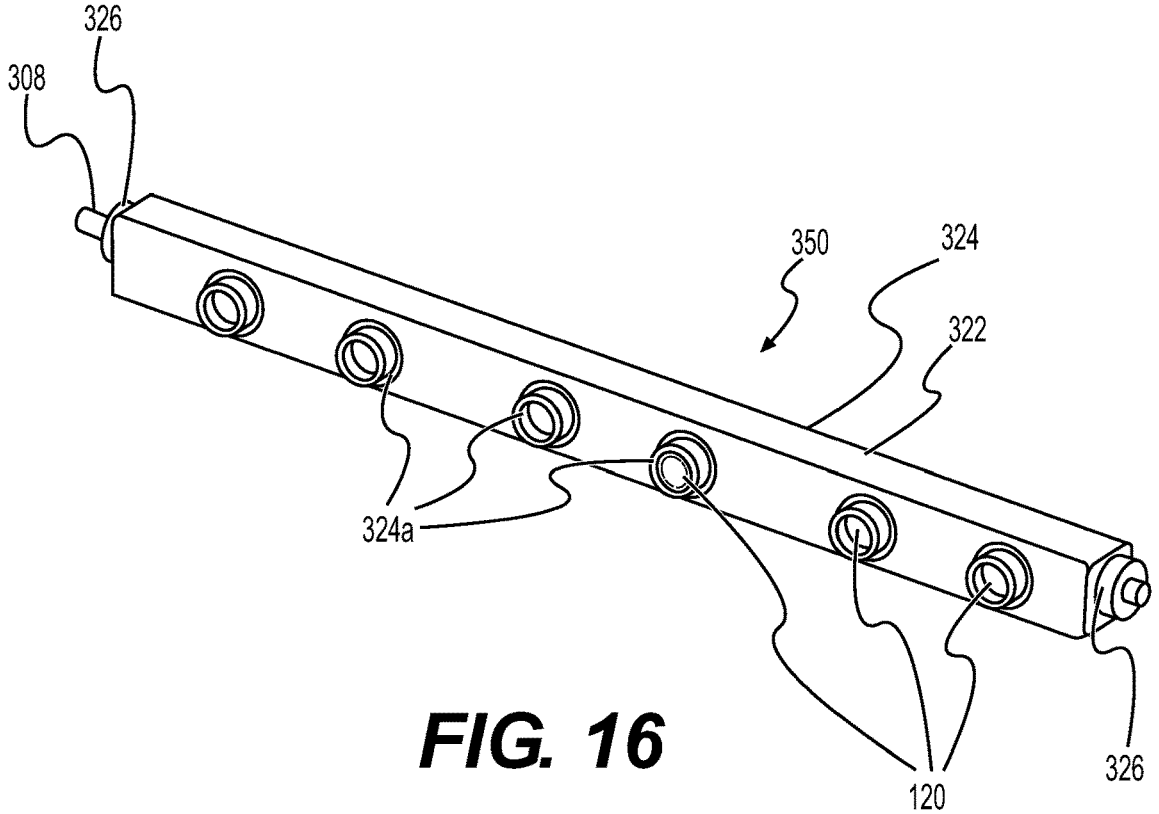
FIG. 16 illustrates schematically a perspective view of the actuation assembly of FIG. 15.
Figure 17:
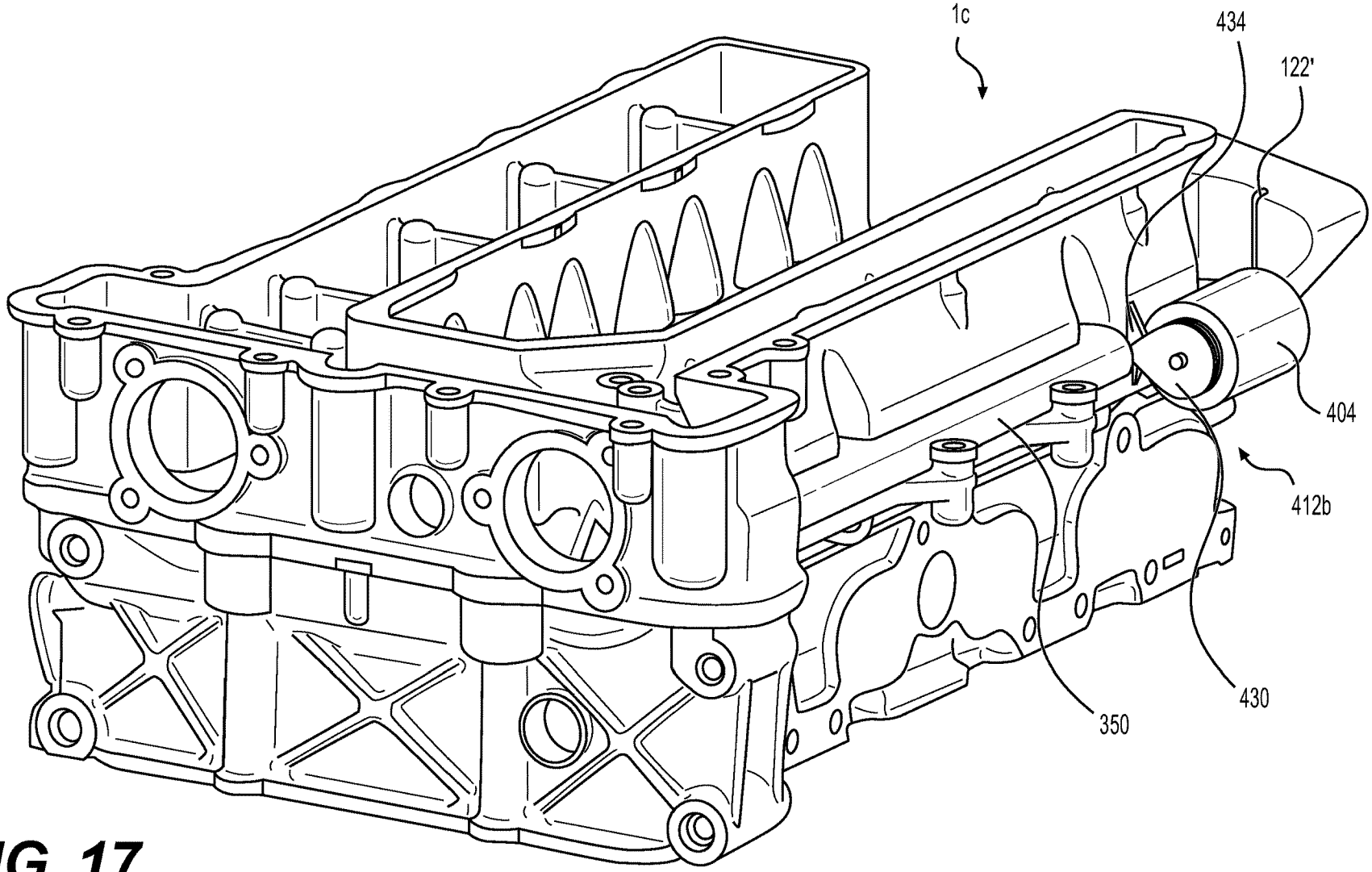
FIG. 17 illustrates schematically a perspective view of a valve train assembly according to a fourth example.
Figure 18:
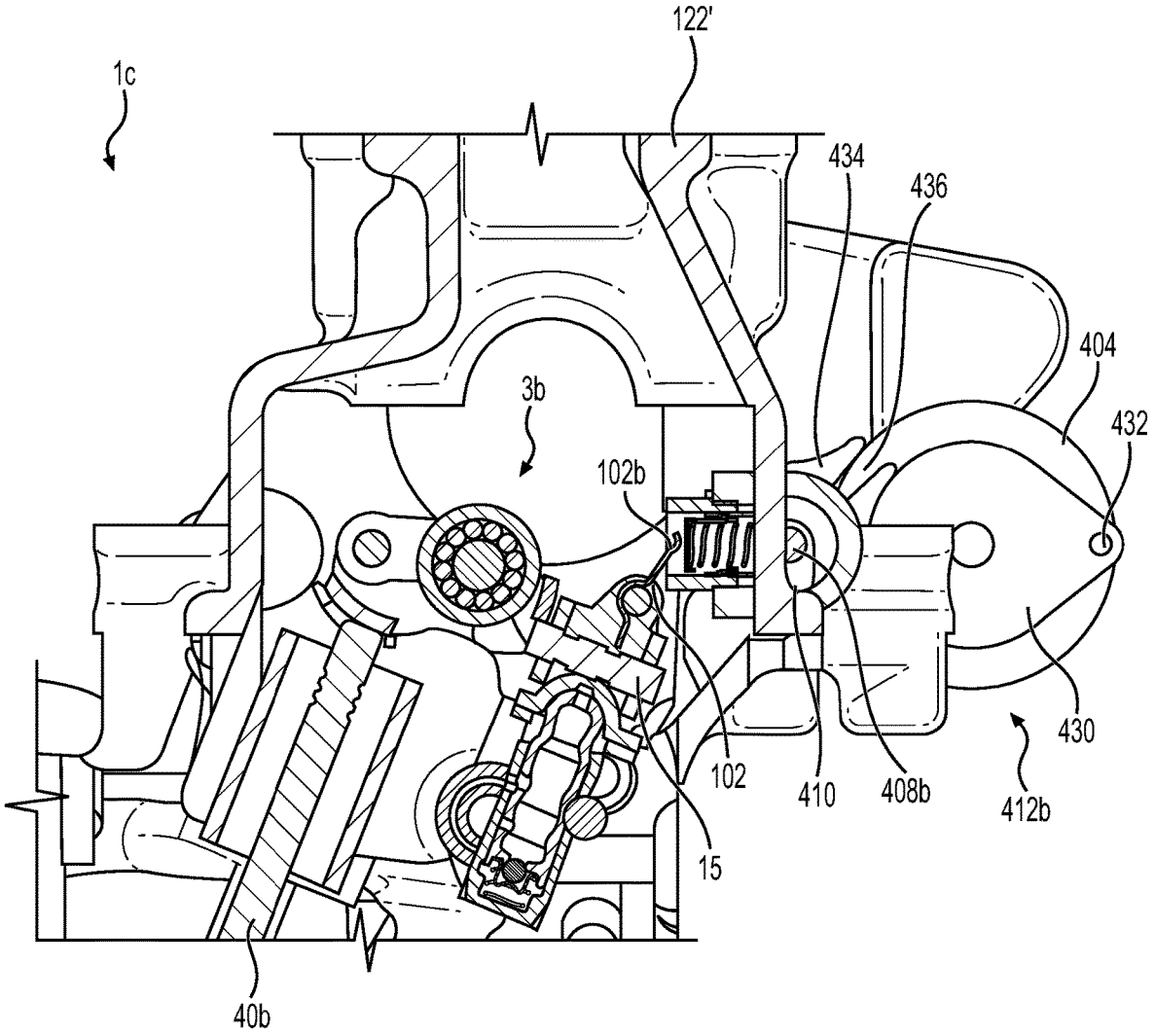
FIG. 18 illustrates schematically a cutaway view of the valve train assembly of FIG. 17.

In the above first and second examples, the compliance arrangements 120 were supported by the cam carrier 122. However, in a third example, illustrated in FIGS. 15 and 16, the compliance arrangements 120 are supported by a main body 322 of an actuation assembly 350 connectable to a cam carrier (not shown in FIGS. 15 and 16, but see cam carrier 122' of FIGS. 17 and 18) of an internal combustion engine. This third example may be the same as the first and/or second examples except for in the abovementioned respect. Referring to FIGS. 15 and 16, the actuation assembly 350 comprises the main body 322, and a shaft 308 supported by the main body 322. The shaft 308 is essentially the same as the shafts 108*a*, 108*b* described above, in that it is rotatable by an actuation source (not shown in FIGS. 15 and 16), and comprises a set of cams 310 for moving latching arrangements 13 of rocker arms 3*a*, 3*b* via the compliance arrangements 120. Although only six compliance arrangement 120 are shown in the actuation assembly 350 of FIGS. 15 and 16, it will be appreciated there may be eight, as per the first and second examples described above. The main body 322 supports the compliance arrangements 120. The compliance arrangements 120 are the same as those described in the above example. The main body 322 comprises a housing 324 connectable to the cam carrier 122'. The housing comprises bearings 326 that support two opposing ends of the shaft 308. The housing 324 comprises hollow cylindrical protrusions 324*a* which support and house the compliance arrangements 120. The housing 324 houses and encloses the cams 310 of the shaft. The actuation assembly 350 is useful as it can be fitted to the cam carrier 122' in an engine plant, hence providing efficient assembly of the engine.

Figure 19:
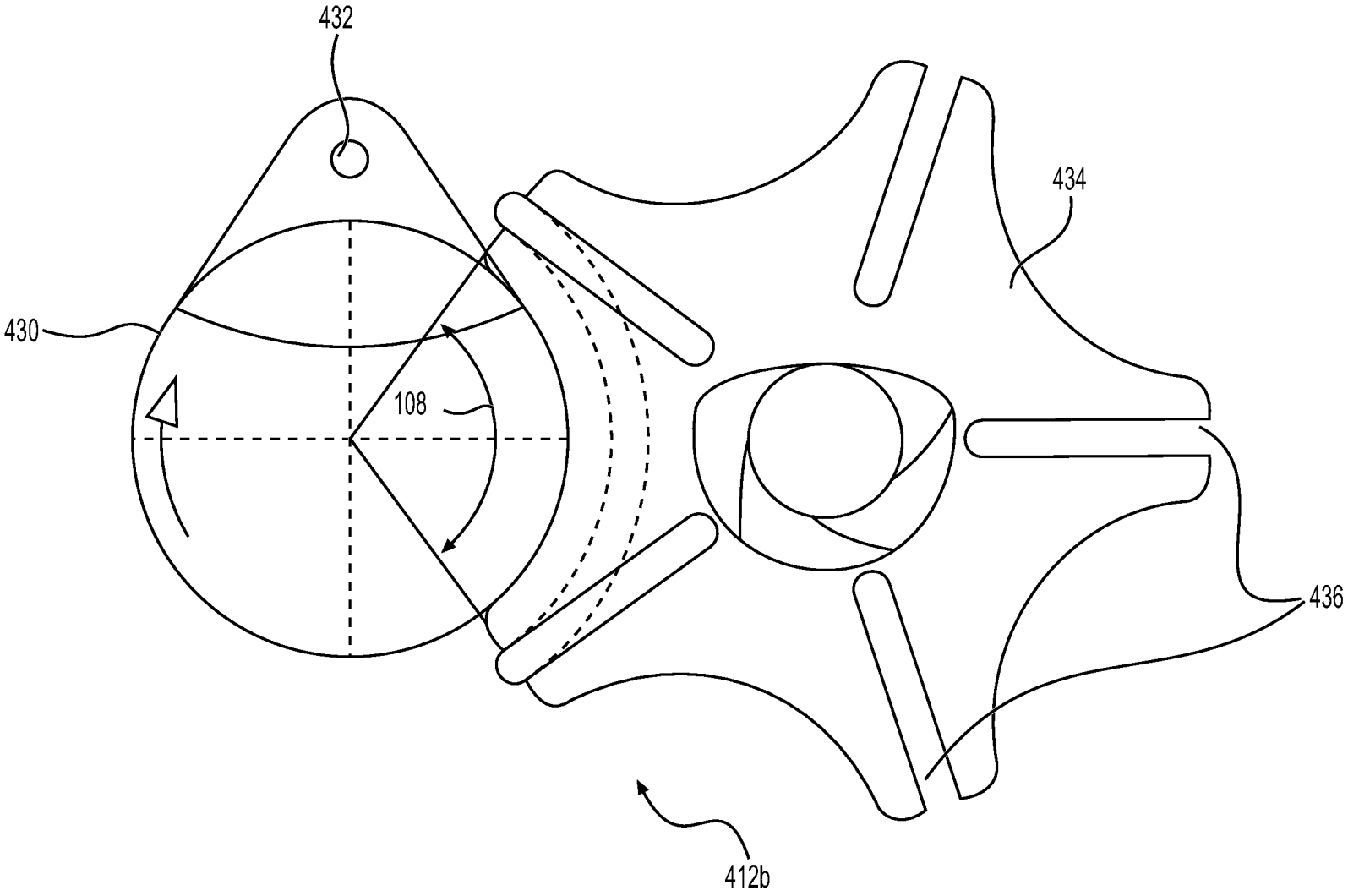
FIG. 19 illustrates schematically two gear mechanisms according to the fourth example.
Figure 20:
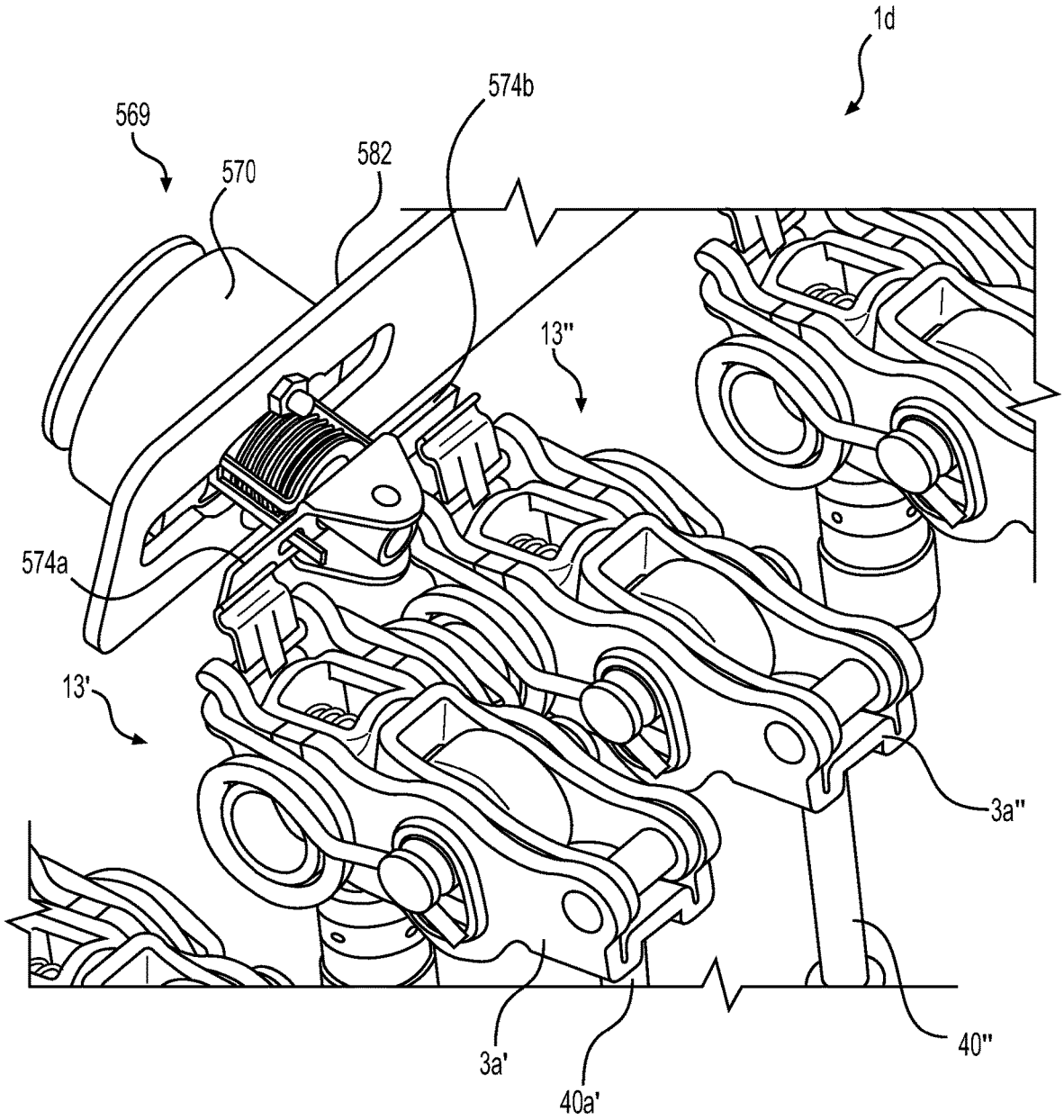
FIG. 20 illustrates schematically a perspective view of a valve train assembly according to a fifth example.
Figure 21:
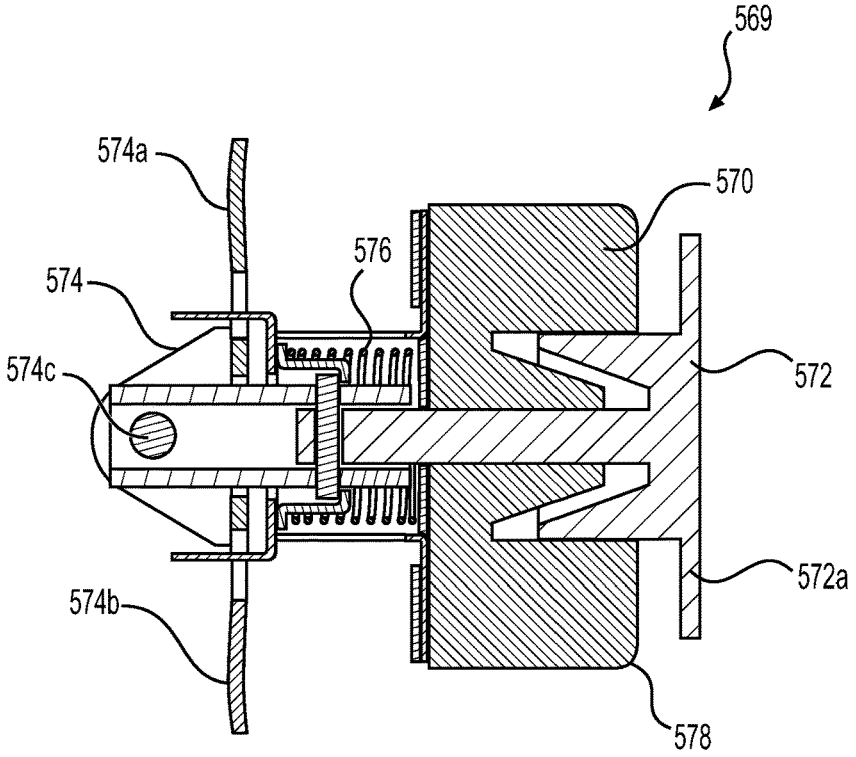
FIG. 21 illustrates schematically a sectional view of an actuator according to the fifth example.
Figure 22:
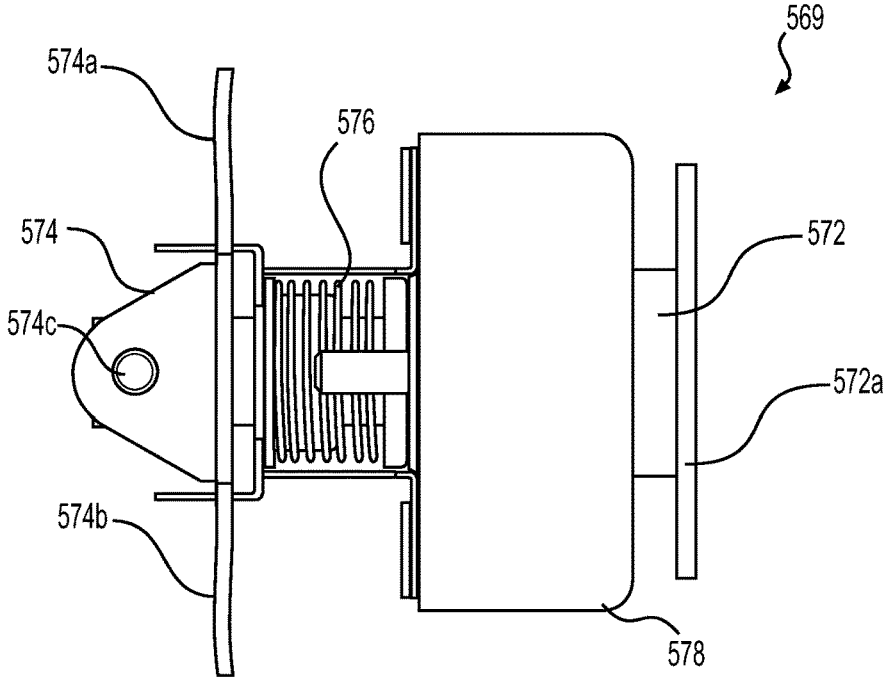
FIG. 22 illustrates schematically a side view of the actuator of FIG. 22.
Figure 23:
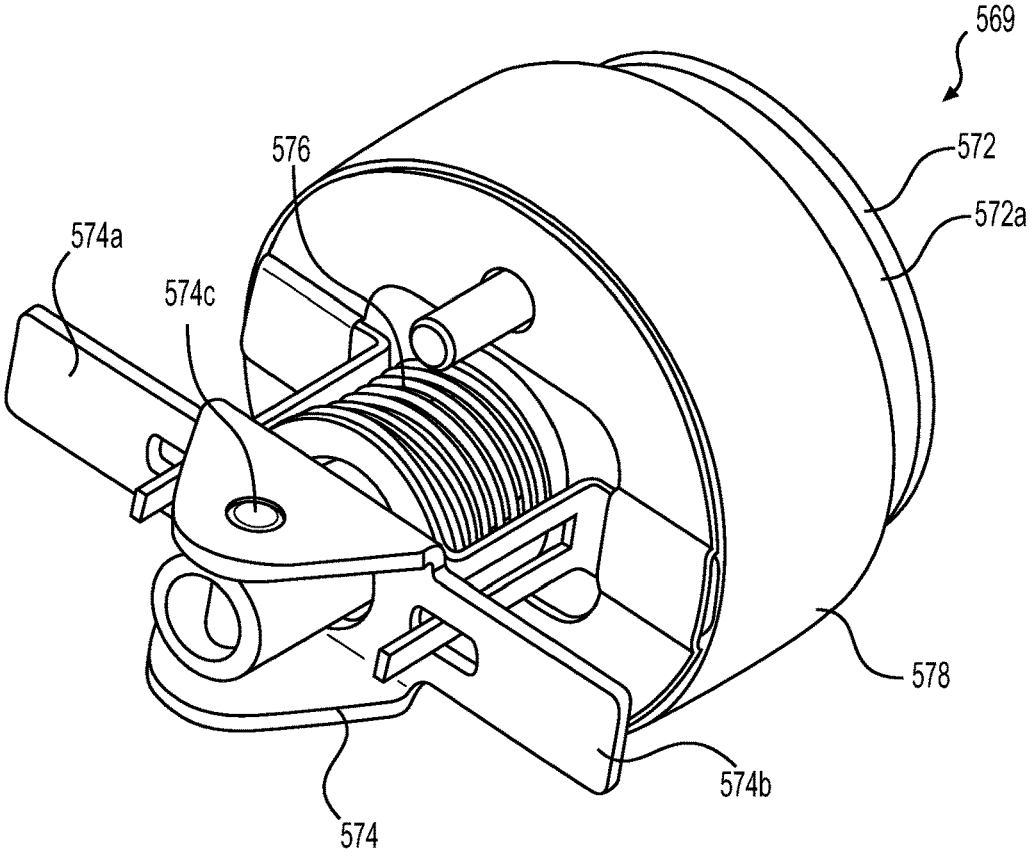
FIGS. 23 and 24 illustrate schematically perspective views of the actuator of FIG. 21, in different configurations.
Figure 24:
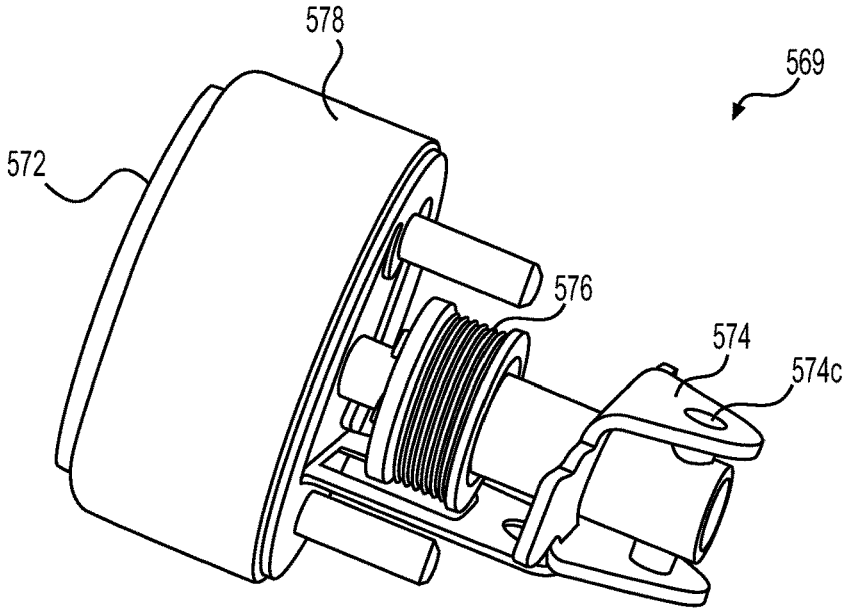
Figure 25:
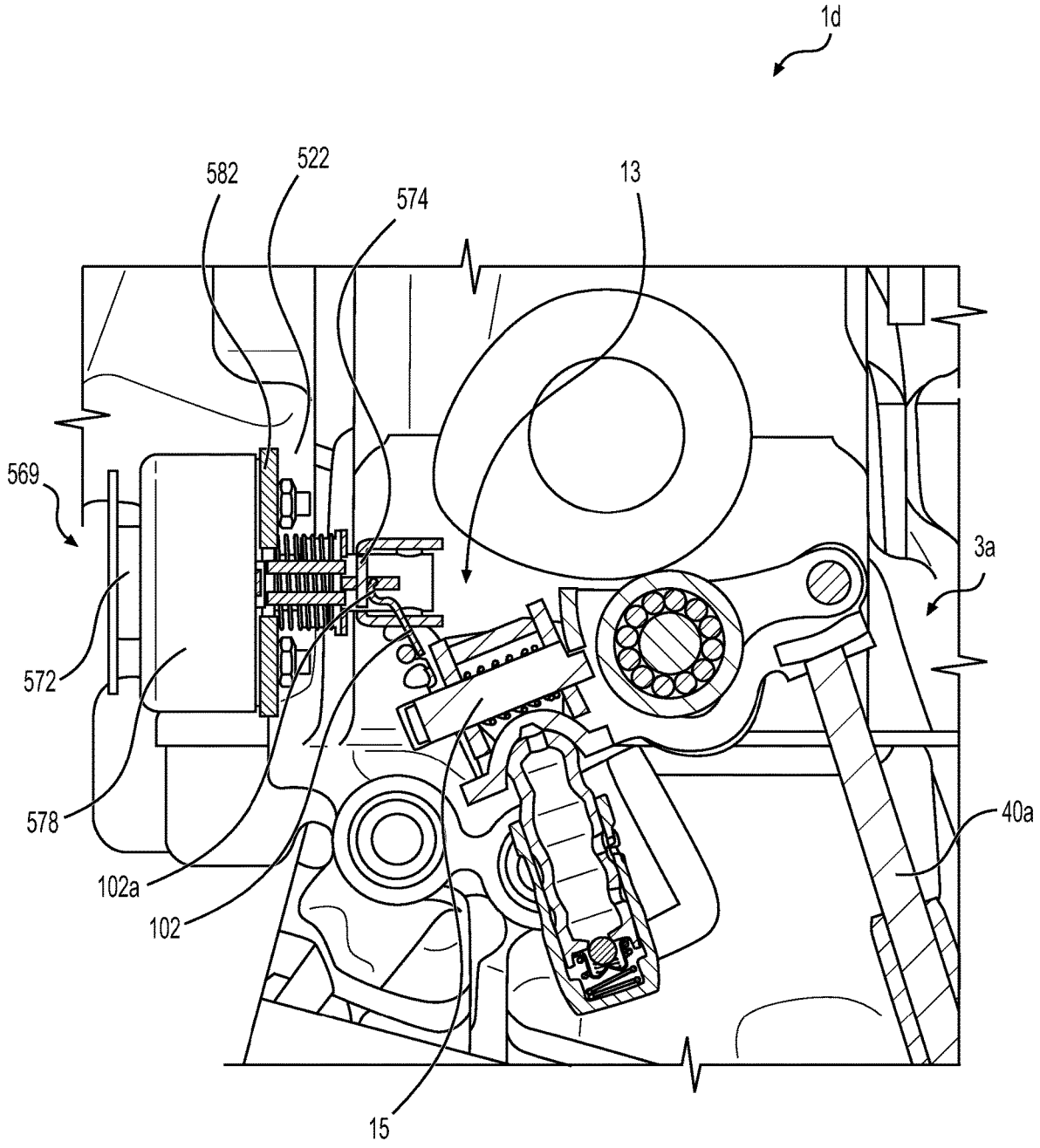
FIG. 25 illustrates schematically a cutaway view of the valve train assembly according to the fifth example.

In the above examples, the actuation source 104 was arranged to drive, via the gear mechanisms 112*a*, 112*b*, both the first shaft 108*a* and the second shaft 108*b*. However, in a fourth example, illustrated in FIGS. 17 to 19, an actuation source 404 is arranged to drive only one shaft 408*b*, via a gear mechanism 412*b*, for example so as to control actuation of latch pins 15 of rocker arms 3*b* of only exhaust valves 40*b* (or of only intake valves, not shown in FIGS. 17 to 19) of an internal combustion engine. This fourth example may be the same as that of the first, second or third examples, except in the abovementioned respect. The shaft 408*b* of this example is the same as the second shaft 108*b* described in the above examples and will not be described again. It will be appreciated that there may be another actuation source arranged to drive another shaft, which another shaft may be the same as the first shaft 108*a* described in the above examples. The actuation source 404 in this example is again an electric motor 404. The actuation source 404 of the valve train assembly 1*c* of this fourth example is arranged to drive the shaft 408*b* via the gear mechanism 412*b*. The gear mechanism 412*b* is similar to the gear mechanisms 112*a*, 112*b* described above in that it is arranged to translate a continuous rotation of the actuation source 404 into an intermittent rotation of the shaft 408*b* in steps of a predefined degree (again, as before, in this example in steps of 72°), so as to orient the cams 410 as described above, so as effect sequential control of the engine operation mode. However, in this example, the axis of rotation of the actuation source 404 is substantially parallel to the axis of rotation of the shaft 408*a*. In this case therefore, the second part 434 of the gear mechanism 412*b* is not concave but is generally flat, such that the slots 436 extend in the plane of rotation of the second part 434. Similarly, the pin 432 of the first part 430 of the gear mechanism 412*b* extends substantially perpendicularly to the plane of rotation of the first part 430, so as to engage with the slots 436 of the second part 434. In use, a continuous rotation of the actuation source 404 causes, via the gear mechanism 412*b*, the shaft 408*b* to rotate in steps of a predefined degree, thereby to change an orientation of the cams relative to latching arrangements by a predefined amount, so as to control the latching arrangement, so as to ultimately control the engine operation mode.

The above examples allow the engine to run different numbers of active cylinders, from all cylinders being active (in a fired mode) to none of the cylinders being active (i.e. all deactivated, i.e. none in a fired mode). As explained above for an I-4 gasoline engine, the above example actuation arrangements and assemblies allow the engine to run with 4, 3, 2, 1 or none of the cylinders active. This allows flexibility in the selection of the engine operation mode.

In the above examples, the latching arrangements 13 of the rocker arms 3*a*, 3*b* were actuated, via the compliance arrangements 120, by cams 110 of one or more shafts 108*a*, 108*b*, the shafts 108*a*, 108*b* being rotated, via one or more gear mechanisms 112*a*, 112*b*, by an actuation source 104. The cams 110 associated with exhaust valves 40*b* (and/or intake valves 40*a*) for a given cylinder had the same shape so that the latching arrangements 13 of the rocker arms 3*a*, 3*b* controlling those valves would be actuated in common. However, in a fifth example, illustrated in FIGS. 20 to 26, an actuator 569 comprising a solenoid 570 is arranged to actuate directly a first latching arrangement 13' of a first rocker arm 3*a*' for controlling a first valve 40*a*' of a first cylinder, and to actuate a second latching arrangement 13" of a second rocker arm 3*a*" for controlling a second valve 40*a*" of the first cylinder, in common. The first valve 40*a*' and the second valve 40*a*" controlled in common by one actuator 569 may both be intake valves 40*a*', 40*a*" of the first cylinder, controlled by rocker arms 3*a*', 3*a*" respectively, or may both be exhaust valves 40*b*', 40*b*" of the first cylinder, controlled by rocker arms 3*b*', 3*b*" respectively. The fifth example may be the same as the first, second, third, or fourth examples apart from in the above mentioned respects.

Referring to FIGS. 20 to 26, the actuator 569 of valve train assembly Id of this fifth example comprises the solenoid 570, a body 572 moveable relative to and by the solenoid 570 from a first position (as per FIGS. 21 to 23) to a second position (as per FIG. 24), and a contact element 574 in mechanical communication with the body 572. The contact element 574 comprises a first region 574*a* for contacting with the first latching arrangement 13' and a second region 574*b* for contacting with the second latching arrangement 13". When the body 572 is in the first position, the contact element 574 does not apply an actuation force to the latching arrangements 13', 13" of the rocker arms 3*a*', 3*a*". However, when the body 572 is in the second position, the contact element 574 contacts and applies an actuation force to the latching arrangements 13', 13" of the rocker arms 3*a*', 3*a*". In use, when the solenoid 570 is energised, the solenoid 570 causes the body 572 to move relative to the solenoid 570 from the first position to the second position, thereby causing the contact element 574 to apply an actuation force to both the first latching arrangement 13' and the second latching arrangement 13" in common. The solenoid 570 and the body 572 may be or comprise a "push pull solenoid" device.

The actuator 569 comprises a biasing element such as a spring 576 arranged to bias the body 572 away from the solenoid 570, from the second position to the first position. This provides that when the solenoid 570 is not energised, the body 572 returns under the force of the spring 576 to the default first position.

The body 572 is moveable relative to and by the solenoid 570 along a first axis. The contact element 574 extends along an axis substantially perpendicular to this first axis. This allows the contact element to translate a movement of the body 572 along one axis, to movement of the latching arrangements 13', 13" along two, parallel, axes.

The contact element 574 is mechanically connected to the body 572 at a point 574*c* between the first region 574*a* and the second region 574*b*. The contact element 574 is mounted for pivotal motion relative to the body 572 about the point 574*c*. The body 572 is received through the solenoid 570. The actuator 569 comprises a housing 578 in which the solenoid 570 is housed. The body 572 is partially received in the housing 578. The body 572 comprises a magnetisable portion 572*a* located at an opposite side of the solenoid 570 to the contact element 574. This allows for a particularly compact actuator 569.

Figure 26:
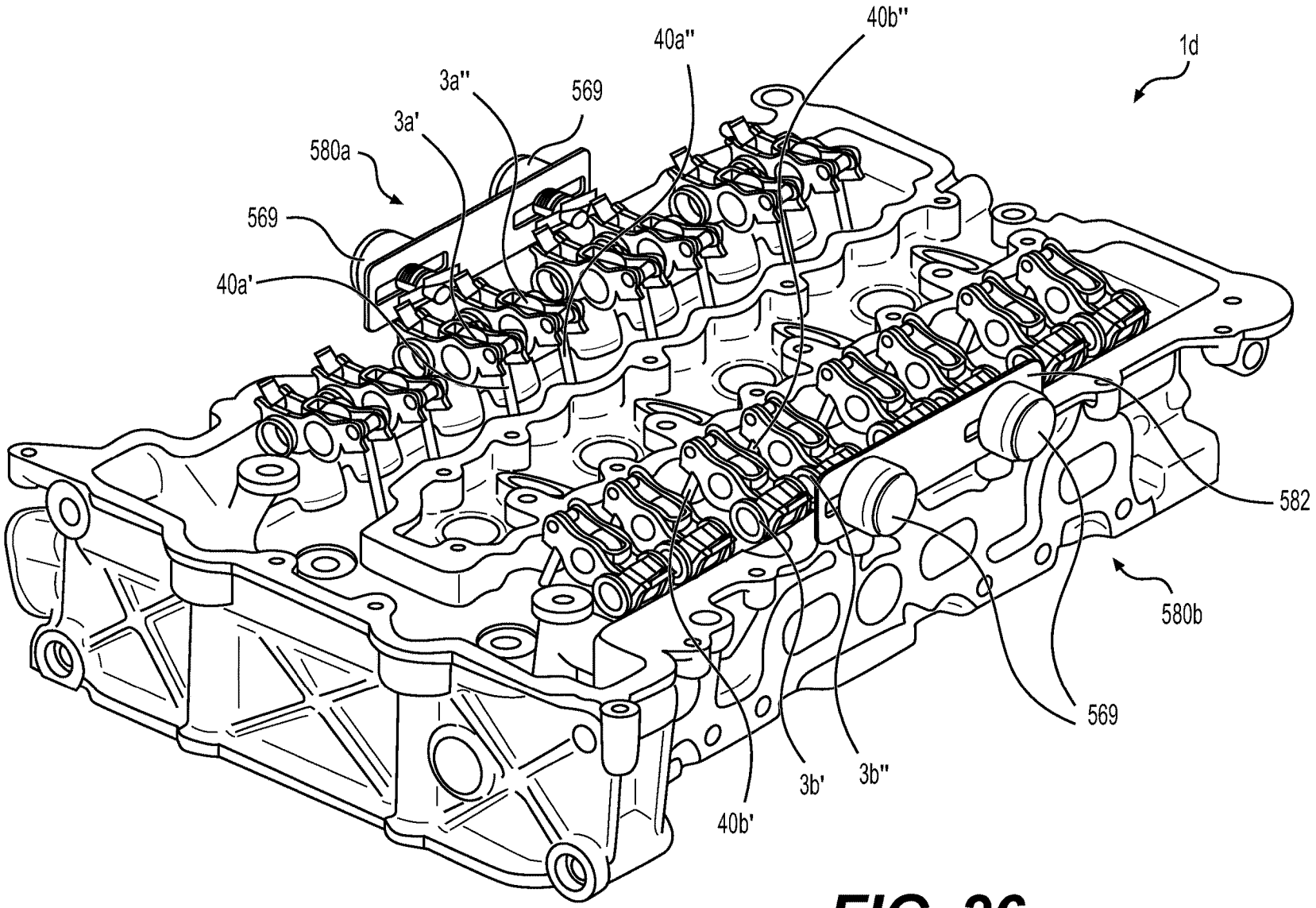
FIG. 26 illustrates schematically a perspective view of the valve train assembly according to the fifth example.

As best seen in FIG. 26, a plurality of the actuators 569 may be used to actuate latching arrangements 13 of rocker arms 3 of the intake valves 40*a*', 40*a*' or the exhaust valves 40*b*', 40*b*" of a respective plurality of cylinders. Referring to FIG. 26, an actuation assembly 580 comprises a plurality of actuators 569, each actuator 569 being associated with the intake valves 40*a*', 40*a*" or the exhaust valves 40*b*', 40*b*" of a different cylinder of an internal combustion engine. The actuation assembly 580 comprises a common support 582 connectable to a cam carrier 522 of the internal combustion engine. Each of the plurality of actuators 569 are connected to the common support 582. The actuation assembly 580 allows for convenient and efficient installment of the plurality of actuators 569 to the engine.

As best seen in FIG. 26, a first actuation assembly 580*a*, comprising two actuators 569, is arranged for actuation of the latching arrangements 13', 13" of the rocker arms 3*a*', 3*a*" of the intake valves 40*a*', 40*a*" of each of the second and third cylinder of the internal combustion engine, and a second actuation assembly 580*b*, comprising two actuators 569, is arranged for actuation of the latch pins 13', 13" of the rocker arms 3*b*', 3*b*" of the exhaust valves 40*b*', 40*b*" of the second and third cylinder of the internal combustion engine. The actuators 569 associated with the intake 40*a*', 40*a*" and exhaust 40*b*', 40*b*" valves of the third cylinder may be controlled by a control unit to actuate the latching arrangements 13 associated with the valves of the third cylinder in common, thereby to deactivate the third cylinder. Similarly, the actuators 569 associated with the intake 40*a*', 40*a*" and exhaust 40*b*', 40*b*" valves of the second cylinder may be controlled by a control unit to actuate the latching arrangements 13 associated with the valves of the second cylinder in common, thereby to deactivate the second cylinder. If all four actuators 569 are controlled to actuate their respective latch pins 13, then both the second and third cylinder will be deactivated.

Although not illustrated, it will be appreciated that the first actuation assembly 580*a* may comprise four actuators 569 each arranged to actuate latching arrangements 13 of the rocker arms 3*a* of the intake valves 40*a* of a different one of the four cylinders, and/or the second actuation assembly 580*b* may comprise four actuators 569 each arranged to actuate latching arrangements 13 of the rocker arms 3*a* of the exhaust valves 40*b* of a different one of the four cylinders. In this way, dynamic skip fire control, in which any of the cylinders may be active (fired) or deactivated (skipped) on a continuously variable basis, may be provided. The use of individual solenoid based actuators 569 therefore allows fully independent activation and deactivation of the cylinders, and hence flexibility in the selection of an engine operation mode.

In some of the examples above, it was described that a compliance arrangement 120 intermediate of the cam 110 and latching arrangement 13 of the rocker arm 3 may be used. However, in examples where the movement of the cams 110 is synchronised with the engine condition, for example synchronised so that a cam 110 attempts to apply an actuation force to the latching arrangement 13 only when the latch pin 15 of the latching arrangement 13 is free to move, or otherwise, then the valve train assembly 1 may not comprise a compliance arrangement 120. Further, it is noted that the examples described above having the actuator 569 comprising a solenoid 570 do neither comprise an compliance arrangement, because energising of the solenoid 570 will cause a constant force to be applied to the latching arrangement 13 such that the latch pin 15 of the latching arrangement 13 will be actuated as soon as it is free to do so.

It will be appreciated that although the above examples relate to an I-4 internal combustion engine having four cylinders, this need not necessarily be the case and that there may be a different number of cylinders and/or the cylinders may be in a different configuration. For example there may be six cylinders.

It will be appreciated that in some examples cam shapes other than those described above may be used provide the control of the rocker arms 3*a*, 3*b*.

Although in the above the dual body rocker arms were described as providing a first primary function of a standard valve opening event and a second secondary function of cylinder deactivation, this need not necessarily be the case, and in other examples, other functions or modes of operation may be provided by the dual body rocker arms. Indeed, the dual body rocker arms may be any dual body rocker arm for controlling a valve of a cylinder, the rocker arm comprising a first body, a second body mounted for pivotal motion with respect to the first body, and a latch pin moveable between a first position in which the latch pin latches the first body and the second body together and a second position in which the first body and the second body are unlatched to allow pivotal motion of the second body relative to the first body. Other functionality such as, for example, internal Exhaust Gas Recirculation (iEGR) may be provided.

Although in some of the above examples the default position of the latch pin 15 was described as latched and that the latch pin 15 is actuated from an unlatched position to a latched position, this need not necessarily be the case and in some examples, the default position of the latch pin 15 may be unlatched, and the actuation arrangement 13 may be arranged to cause the latch pin to move from the unlatched position to the latched position, i.e. the actuation arrangement 13 and/or the actuator 569 etc may be arranged to actuate the latching arrangement so as to cause the latch pin to move from the unlatched position to the latched position. Indeed, the actuating arrangement may be arranged to move the respective latch pins of one or more dual body rocker arms from one of the latched and unlatched positions to the other of the latched and unlatched positions.

It is to be understood that any feature described in relation to any one example may be used alone, or in combination with other features described, and may also be used in combination with one or more features of any other of the examples, or any combination of any other of the examples.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

REFERENCE SIGNS LIST

1, 1*a*, 1*c*, Id valve train assembly
3*a*, 3*b*, 3*a*', 3*a*", 3*b*', 3*b*" dual body rocker arm
7 outer body
7*a*, 7*b* ends of outer body
8*a*, 8*b* protrusions
8*c* curved surface
9 inner body
11 pivot axis
13, 13', 13" latching arrangement
15 latch pin
15*a* slot
16 return spring
16*a* washer
17 roller follower
17*a* roller
17*b* needle bearings
17*c* roller axle
21 torsional biasing device
21*a*, 21*b* coiled sections
21*c* non-coiled section

40*a*, 40*a*', 40*a*" intake valve
40*b*, 40*b*', 40*b*" exhaust valve
41*a*, 41*b* valve stem
42 Hydraulic Lash Adjuster (HLA)
43*a*, 43*b* cam
44*a*, 44*b* camshaft
100 actuation arrangement
102 lever
102*a* first end
102*b* second end
102*c* protrusion
104, 104', 404 actuation source
106 actuation transmission arrangement
108, 108*a*, 108*b*, 308, 408*b* shaft
110, 110*a*, 110*b*, 11Op, 11Oq, 11 Or,
110*s*, 410 cams
112, 112*a*, 112*b*, 412*b* gear mechanism
116 base circle
118 raised profile
120 compliance arrangement
120*a* first portion
120*b* second portion
122, 122' cam carrier
124 biasing element
130, 430 first part
132, 432 pin
134, 434 second part
136, 436 slots
138 arcuate protrusion
140 arcuate recess
150, 250 electric motor
156, 256 output shaft
252 spur gear
254 gear housing
258, 326 bearings
260 drive shaft
322 main body
324 housing
324*a* hollow cylindrical protrusion 350 actuation assembly
569 actuator
570 solenoid
572 body
572*a* magnetisable portion
574 contact element
574*a* first region
574*b* second region
574*c* pivot point
576 biasing element
578 housing
580, 580*a*, 580*b* actuation assembly
582 common support

The invention claimed is:

1. A dual body rocker arm for controlling a valve of a cylinder of an internal combustion engine, the dual body rocker arm comprising:
a first body;
a second body; and
a latching arrangement moveable to latch and unlatch the first body and the second body, the latching arrangement comprising:
a latch pin moveable between a first position in which the latch pin latches the first body and the second body together and a second position in which the first body and the second body are un-latched; and
a lever mounted for pivotal motion relative to the first body, a first end of the lever contacting the latch pin, and a second end of the lever configured to contact an actuator;
wherein, in use, when the actuator exerts a force on the second end of the lever, the lever is configured to pivot such that the first end of the lever pulls the latch pin to move the latch pin from the first position to the second position.

2. The dual body rocker arm according to claim 1, wherein the second body is connected to the first body for pivoting movement relative to the first body about a pivot axis, and
wherein the latching arrangement is at an opposite side of the dual body rocker arm to the pivot axis.

3. The dual body rocker arm according to claim 1, wherein the latching arrangement comprises a biasing element configured to bias the latch pin towards the first position.

4. The dual body rocker arm according to claim 1, wherein the dual body rocker arm is configured for cylinder deactivation.

5. The dual body rocker arm according to claim 4, wherein, in use, the dual body rocker arm provides cylinder deactivation when the latch pin is in the second position.

6. A valve train assembly of an internal combustion engine, comprising:
the dual body rocker arm according to claim 1; and
the actuator.

7. The valve train assembly according to claim 6, wherein the actuator comprises a shaft rotatable by an actuation source, the shaft comprising a cam configured to control the latching arrangement.

8. The valve train assembly according to claim 6, wherein the actuator comprises a solenoid and a body moveable relative to and by the solenoid to control the latching arrangement.

9. The dual body rocker arm according to claim 1, wherein the lever is arranged to orient the latch pin rotationally with respect to the first body.

10. A dual body rocker arm for controlling a valve of a cylinder of an internal combustion engine, the dual body rocker arm comprising:
a first body;
a second body; and
a latching arrangement moveable to latch and unlatch the first body and the second body, the latching arrangement comprising:
a latch pin moveable between a first position in which the latch pin latches the first body and the second body together and a second position in which the first body and the second body are un-latched; and
a lever mounted for pivotal motion relative to the first body, a first end of the lever contacting the latch pin, and a second end of the lever configured to contact an actuator;
wherein, in use, when the actuator exerts a force on the second end of the lever, the lever is configured to pivot such that the first end of the lever exerts a force on the latch pin, thereby to move the latch pin from the first position to the second position,
wherein the lever is arranged to orient the latch pin rotationally with respect to the first body, and
wherein the second end of the lever defines a protrusion, and the latch pin defines a transverse slot into which the protrusion is received, thereby to orient the latch pin rotationally with respect to the lever.

11. The dual body rocker arm according to claim 10, wherein the second body is connected to the first body for pivoting movement relative to the first body about a pivot axis, and wherein the latching arrangement is at an opposite side of the dual body rocker arm to the pivot axis.

12. The dual body rocker arm according to claim 10, wherein the latching arrangement comprises a biasing element configured to bias the latch pin towards the first position.

13. A dual body rocker arm for controlling a valve of a cylinder of an internal combustion engine, the dual body rocker arm comprising:

a first body;

a second body; and a latching arrangement moveable to latch and unlatch the first body and the second body, the latching arrangement comprising:

a latch pin moveable between a first position in which the latch pin latches the first body and the second body together and a second position in which the first body and the second body are un-latched; and a lever mounted for pivotal motion relative to the first body, a first end of the lever contacting the latch pin, and a second end of the lever configured to contact an actuator;

wherein, in use, when the actuator exerts a force on the second end of the lever, the lever is configured to pivot such that the first end of the lever exerts a force on the latch pin, thereby to move the latch pin from the first position to the second position, wherein the dual body rocker arm comprises a torsional biasing device supported by the first body and arranged to bias the second body relative to the first body, and wherein the lever is mounted on a portion of the torsional biasing device for pivotal motion relative to the first body.

14. The dual body rocker arm according to claim 13, wherein the second body is connected to the first body for pivoting movement relative to the first body about a pivot axis, and wherein the latching arrangement is at an opposite side of the dual body rocker arm to the pivot axis.

15. The dual body rocker arm according to claim 13, wherein the latching arrangement comprises a biasing element configured to bias the latch pin towards the first position.

16. A dual body rocker arm comprising:

a first body;

a second body;

a latch pin moveable between a first position in which the latch pin latches the first body and the second body together and a second position in which the first body and the second body are un-latched; and a lever pivotally mounted to the first body so as to allow the lever to move pivotally relative to the first body, the lever comprising a first end configured to contact the latch pin and a second end configured to contact an actuator, wherein, when the actuator exerts a force on the second end of the lever, the lever is configured to pivot such that the first end of the lever causes the latch pin to move from the first position to the second position.

17. The dual body rocker arm according to claim 16, further comprising a torsional biasing device configured to bias the second body relative to the first body, wherein the lever is pivotally mounted to the first body via the torsional biasing device.

18. The dual body rocker arm according to claim 16, wherein the first end of the lever is configured to pull the latch pin from the first position to the second position when the actuator exerts the force on the second end of the lever.

19. The dual body rocker arm according to claim 16, wherein, when the actuator exerts the force on the second end of the lever, the lever is configured to pivot such that the first end of the lever pulls the latch pin from the first position to the second position.

20. The dual body rocker arm according to claim 16, wherein the first body and the second body are pivotally connected to one another with respect to a pivot axis, and wherein the latch pin is located at an opposite side of the dual body rocker arm to the pivot axis.

* * * * *